US008164551B2

(12) United States Patent
Takahashi

(10) Patent No.: US 8,164,551 B2
(45) Date of Patent: Apr. 24, 2012

(54) LIQUID CRYSTAL DISPLAY DEVICE

(75) Inventor: Hiroyuki Takahashi, Funabashi (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 989 days.

(21) Appl. No.: 12/128,717

(22) Filed: May 29, 2008

(65) Prior Publication Data

US 2008/0297673 A1 Dec. 4, 2008

(30) Foreign Application Priority Data

May 30, 2007 (JP) ..... 2007-142776

(51) Int. Cl.
*G09G 3/36* (2006.01)

(52) U.S. Cl. ..... 345/87; 345/94

(58) Field of Classification Search ..... 345/87–104
See application file for complete search history.

(56) References Cited

U.S. PATENT DOCUMENTS 6,373,456 B1 * 4/2002 Matsubara ..... 345/94
6,727,878 B2 * 4/2004 Okuzono et al. ..... 345/96
7,002,563 B2 * 2/2006 Nakamura ..... 345/204

FOREIGN PATENT DOCUMENTS

JP 05-224626 9/1993

* cited by examiner

*Primary Examiner* — Jimmy H Nguyen
(74) *Attorney, Agent, or Firm* — Antonelli, Terry, Stout & Kraus, LLP.

(57) ABSTRACT

A liquid crystal display device included in a compact portable device reduces burden imposed on a driver circuit for driving counter electrodes and produces images having preferable quality. The liquid crystal display device includes liquid display element and liquid crystal driving circuit. The liquid crystal driving circuit drives two counter electrode signal lines during one scanning period for driving one scanning signal line. Counter signals having different polarities are supplied to the two counter signal lines. Since the number of pixels operated by one counter electrode signal line is decreased to half, burden imposed during drive of counter electrodes is reduced.

1 Claim, 22 Drawing Sheets

LIQUID CRYSTAL DISPLAY DEVICE

BACKGROUND OF THE INVENTION

1. Field of the Invention

The present invention relates to a liquid crystal display device, and more particularly to a technology effectively used when applied to a liquid crystal display device included in a display unit of a portable device.

2. Background Art

Currently, a TFT (thin film transistor) system liquid crystal display device has been widely used as a display device of a personal computer, TV, and other apparatus. This liquid crystal display device has a liquid crystal display panel and a driver circuit for driving the liquid crystal display panel.

Also, a number of miniaturized liquid crystal display device of this type has been increasing as a display unit of a portable device such as a cellular phone. In case of the liquid crystal display device as the display unit of the portable device, the power consumption of the liquid crystal display device is preferably smaller than that of a conventional type of liquid crystal display device.

JP-A-5-224626 discloses a technology which includes a common gate driver for supplying common voltage to a liquid crystal panel and supplies common voltage to respective scanning signal lines. However, this reference does not show how to control the common voltage.

SUMMARY OF THE INVENTION

In case of the liquid crystal display device as the display unit of the portable device, further power consumption reduction has been demanded. Thus, the liquid crystal display device including the driver circuit operable by low voltage is currently under development. According to the conventional liquid crystal display device, the grey scale voltage applied to pixel electrodes is inverted with the common voltage kept constant. However, for achieving low-voltage drive, so-called common alternating drive (counter voltage inverting drive) which changes the polarity of the common voltage to the polarity opposite to that of the voltage applied to the pixel electrodes has been performed.

In the common alternating drive, however, the common voltage varies according to the level of the voltage inputted to the pixel electrodes or the lengths of the signal lines.

More specifically, according to the common alternating drive, common voltage for positive electrode or negative electrode is supplied from one common wire to all pixels constituting a line to be scanned.

In this system, the volume of charges to be supplied via one common wire rises as the number of pixels in the horizontal direction increases. In this case, sufficient supply capability is difficult to be obtained. When the number of pixels in the vertical direction increases, the period for scanning one line decreases under the condition of the same frame frequency. In this case, the time required for supplying sufficient charges from one common wire cannot be obtained. As a result, the problem of common voltage fluctuations caused by voltage change of the pixel electrodes becomes remarkable.

The necessity for supplying a larger amount of current in a shorter time increases as the level of resolution rises. Thus, reduction of wire resistance is needed so as to decrease fluctuation of the common voltage to such an extent that no problem occurs. However, with the demand for higher aperture ratio, reduction of the widths of the common wires is rather required so as to increase the aperture ratio.

The invention has been developed to solve the problems arising from the technologies in the related art. It is an object of the invention to provide a structure of driver circuit and liquid crystal display panel included in a compact liquid crystal display device capable of applying common voltage in a stable manner.

The above-described and additional objects and novel characteristics of the invention will be clarified from the description of this specification and the accompanying drawings.

The outlines of chief aspects according to disclosure of the invention are hereinafter described.

A liquid crystal display device in an example includes: two substrates; a liquid crystal constituent sandwiched between the two substrates; a plurality of pixels provided on the substrate; pixel electrodes provided on the pixels; counter electrodes opposed to the pixel electrodes; switching elements which supply image signals to the pixel electrodes when the switching elements are turned on; image signal lines which supply image signals to the switching elements; scanning signal lines which supply scanning signals for controlling ON and OFF of the switching elements; counter electrode signal lines which supply counter voltage to the counter electrodes; a first driver circuit which outputs the image signals; a second driver circuit which outputs the scanning signals; and a third driver circuit which outputs the counter voltage.

A first pixel electrode which receives image signals from the switching element controlled by a first scanning signal line, a second pixel electrode which receives image signals from the switching element controlled by a second scanning signal line, and a third pixel electrode which receives image signals from the switching element controlled by a third scanning signal line are provided on the adjoining first, second, and third scanning signal lines, respectively. A first counter electrode signal line is connected with the counter electrode opposed to the first pixel electrode. A second counter electrode signal line is connected with the counter electrode opposed to the second pixel electrode. A third counter electrode signal line is connected with the counter electrode opposed to the third pixel electrode. Counter voltage having polarity opposite to that of the voltage applied during the previous closest frame period is supplied to the counter electrode of the second pixel electrode and the counter electrode of the third pixel electrode during a first scanning period for outputting scanning signals to the first scanning signal line.

According to this structure, counter electrode voltage for positive electrode and counter voltage for negative electrode can be supplied by two counter electrode signal lines during one scanning period. In this case, the volume of charges to be supplied by one counter voltage signal line during one scanning period is decreased. Thus, the counter electrodes can be sufficiently operated, and fluctuations in the counter electrode voltage can be reduced.

A liquid crystal display device in another example includes: two substrates; a liquid crystal constituent sandwiched between the two substrates; a plurality of pixels provided on the substrate; pixel electrodes provided on the pixels; counter electrodes opposed to the pixel electrodes; switching elements which supply image signals to the pixel electrodes when the switching elements are turned on; image signal lines which supply image signals to the switching elements; scanning signal lines which supply scanning signals for controlling ON and OFF of the switching elements; counter electrode signal lines which supply counter voltage to the counter electrodes; a first driver circuit which outputs the image signals to the image signal lines; a second driver circuit which outputs the scanning signals to the scanning signal lines; and a third driver circuit which outputs the counter voltage to the counter electrode signal lines.

The plural pixel electrodes are provided along the scanning signal lines. Each of the plural pixel electrodes has the switching element. Image signals are supplied to the plural pixel electrodes under the control of scanning signals during one scanning period for supplying scanning signals to the scanning signal lines.

A first pixel electrode controlled by a first scanning signal line, a second pixel electrode controlled by a second scanning signal line, and a third pixel electrode controlled by a third scanning signal line are provided on the first, second, and third scanning signal lines of the scanning signal lines, respectively. A second counter electrode opposed to the second pixel electrode and a third counter electrode opposed to the third pixel electrode are operated in such a manner that counter voltages supplied to these counter electrodes have opposite polarities. Counter voltages are supplied to the second and third counter electrodes during a first scanning period for outputting scanning signals to the first scanning signal line.

DETAILED DESCRIPTION OF THE EMBODIMENTS

An embodiment of the invention is hereinafter described in detail with reference to the drawings. In the respective drawings depicting this embodiment, like reference numbers are given to components having like functions, and the same explanation is not repeated.

Figure 1:
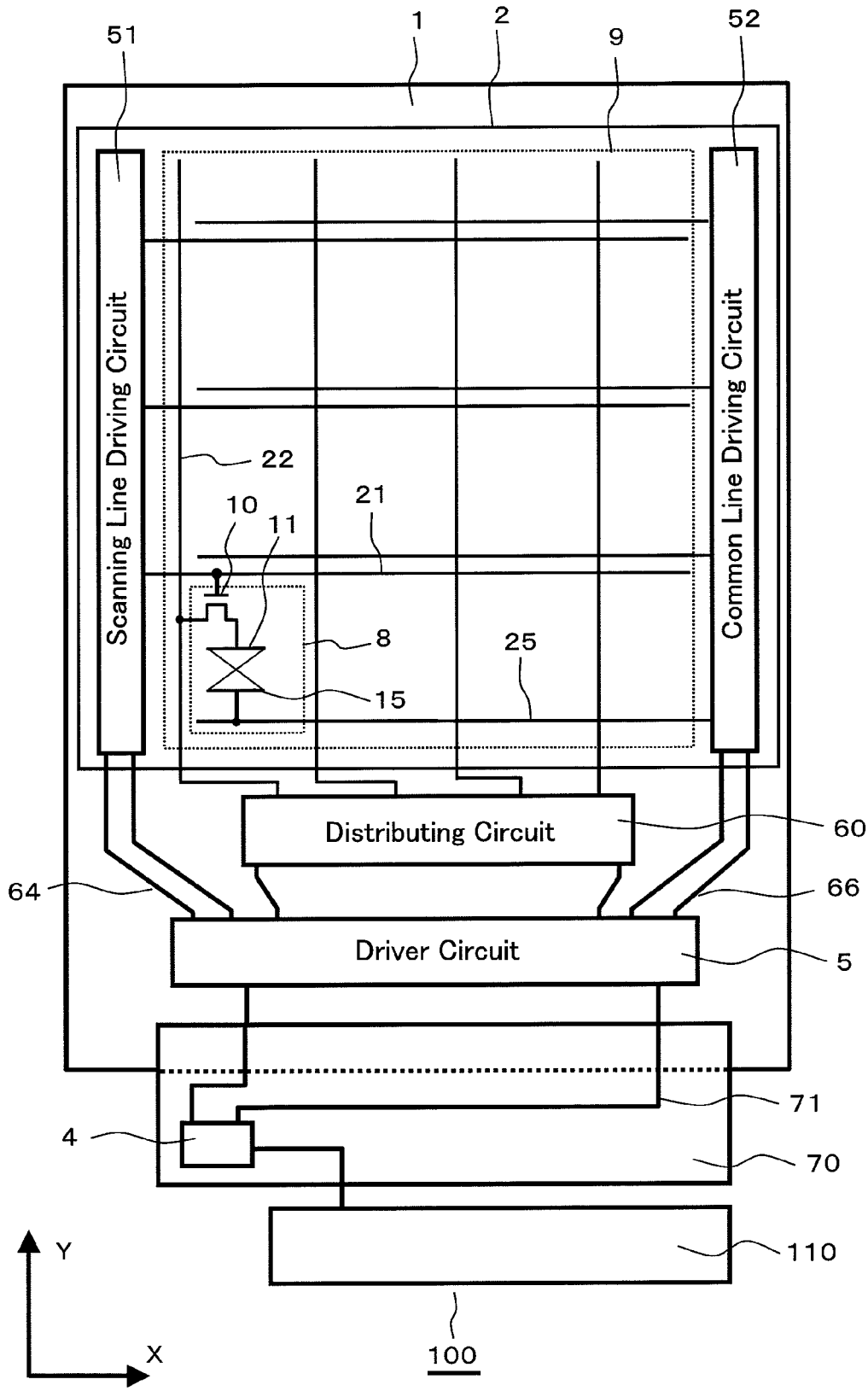
FIG. 1 is a block diagram schematically showing a liquid crystal display device according to an embodiment of the invention.

FIG. 1 is a block diagram showing a basic structure of a liquid crystal display device according to the embodiment of the invention. As illustrated in the figure, a liquid display device 100 according to this embodiment includes a liquid crystal display panel 1, a driver circuit 5, a flexible substrate 70, a backlight 110, and a housing case (not shown).

The liquid crystal display panel 1 contains a TFT substrate 2 on which thin film transistors 10, pixel electrodes 11, counter electrodes 15, and the like are provided, and a color filter substrate (not shown) on which color filters and the like are provided. The TFT substrate 2 and the color filter substrate are overlapped with each other with a predetermined space left therebetween, and affixed to each other by a frame-shaped seal member provided in the vicinity of the peripheries of the two substrates. A liquid crystal constituent is sealed into the inner side of the two substrates and the seal member. A polarizer is further affixed to the outside of the two substrates to constitute the liquid crystal display panel 1.

The structure according to this embodiment is applicable to a so-called in-plane switching mode liquid crystal display panel having the counter electrodes 15 on the TFT substrate 2, and a so-called vertical switching mode liquid crystal display panel having the counter electrodes 15 on the color filter substrate.

The TFT substrate 2 has scanning signal lines 21 (called gate lines as well) extending in the x direction and disposed in parallel in the y direction in the figure, and image signal lines 22 (called drain lines as well) extending in the y-direction and disposed in parallel in the x direction. Pixel units 8 are formed in areas surrounded by the scanning signal lines 21 and the image signal lines 22.

The liquid crystal display panel 1 has a number of pixel units 8 disposed in matrix, but FIG. 1 shows only one pixel unit 8 for simplifying the figure. The pixel units 8 disposed in matrix form a display area 9. The respective pixel units 8 function as pixels for a display image and display the corresponding image on the display area 9.

Each of the thin film transistors 10 of the respective pixel units 8 has source, drain, and gate. The source is connected with the pixel electrode 11. The drain is connected with the image signal line 22. The gate is connected with the scanning signal line 21. The thin film transistors 10 function as switches for supplying display voltage (grey scale voltage) to the pixel electrodes 11.

It is possible that the source and drain are reversely called depending on the condition of bias. In this example, the one connected with the image signal 22 is called drain.

The driver circuit 5 is disposed on a transparent insulation substrate (glass substrate, resin substrate or the like) constituting the TFT substrate 2. The driver circuit 5 is electrically connected with a scanning line driver circuit 51, a distributing circuit 60, and a counter electrode line driver circuit 52.

The flexible substrate 70 is connected with the TFT substrate 2. The flexible substrate 70 has a connector 4.

The connector 4 is connected with an external signal line to receive signals from the outside. A wire 71 is provided between the connector 4 and the driver circuit 5, and the signals from the outside are inputted to the driver circuit 5 via the wire 71.

The liquid crystal display panel 1 as a non-emission element requires light source. A backlight 110 is equipped on the liquid crystal display device 100 to supply light to the liquid crystal display panel 1. The liquid crystal display panel 1 controls the amount of transmission and reflection of the received light for display. The backlight 110 is disposed on the rear or front surface of the liquid crystal display panel 1, but is positioned in parallel with the liquid crystal display panel 1 in FIG. 1 for simplifying the figure.

Control signals generated from a controller (not shown) provided outside the liquid crystal display device 100 and source voltage supplied from an external power supply circuit are inputted to the driver circuit 5 via the connector 4 and a wire 31.

The signals inputted to the driver circuit 5 from the outside involve signals such as clock signal, display timing signal, horizontal synchronous signal, and vertical synchronous signal, display data (R, G, and B), and display mode control commands. The driver circuit 5 operates the liquid display panel 1 based on the inputted signals.

The driver circuit 5 is constituted by a 1-chip semiconductor integrated circuit (LSI). The driver circuit 5 outputs control signals to the scanning line driving circuit 51 via a control signal line 64, and outputs control signals to the counter electrode line driver circuit 52 via a control signal line 66. The driver circuit 5 also outputs image signals to the distributing circuit 60.

The scanning line driving circuit 51 sequentially supplies "high" level selection voltage (scanning signal) to the respective scanning signal lines 21 of the liquid crystal display panel 1 in each one horizontal scanning period based on reference clock generated within the driver circuit 5. Then, the plural thin film transistors 10 connected to the respective scanning signal lines 21 of the liquid crystal display panel 1 provides electrical continuity between the image signal lines 22 and the pixel electrodes 11 during one horizontal scanning period.

The driver circuit 5 outputs grey scale voltage (image signal) corresponding to the grey scale to be displayed by the pixels to the distributing circuit 60. The distributing circuit 60 divides one horizontal scanning period and distributes grey scale voltage to each of the different image signal lines 22. The grey scale voltage supplied from the distributing circuit 60 to the image signal lines 22 is further supplied from the image signal lines 22 to the pixel electrodes 11 via the thin film transistors 10 under ON (continuity) condition. Then, the grey scale voltage corresponding to the image to be displayed by the pixels are retained on the pixel electrodes 11 by turning off the thin film transistors 10.

Figure 2:
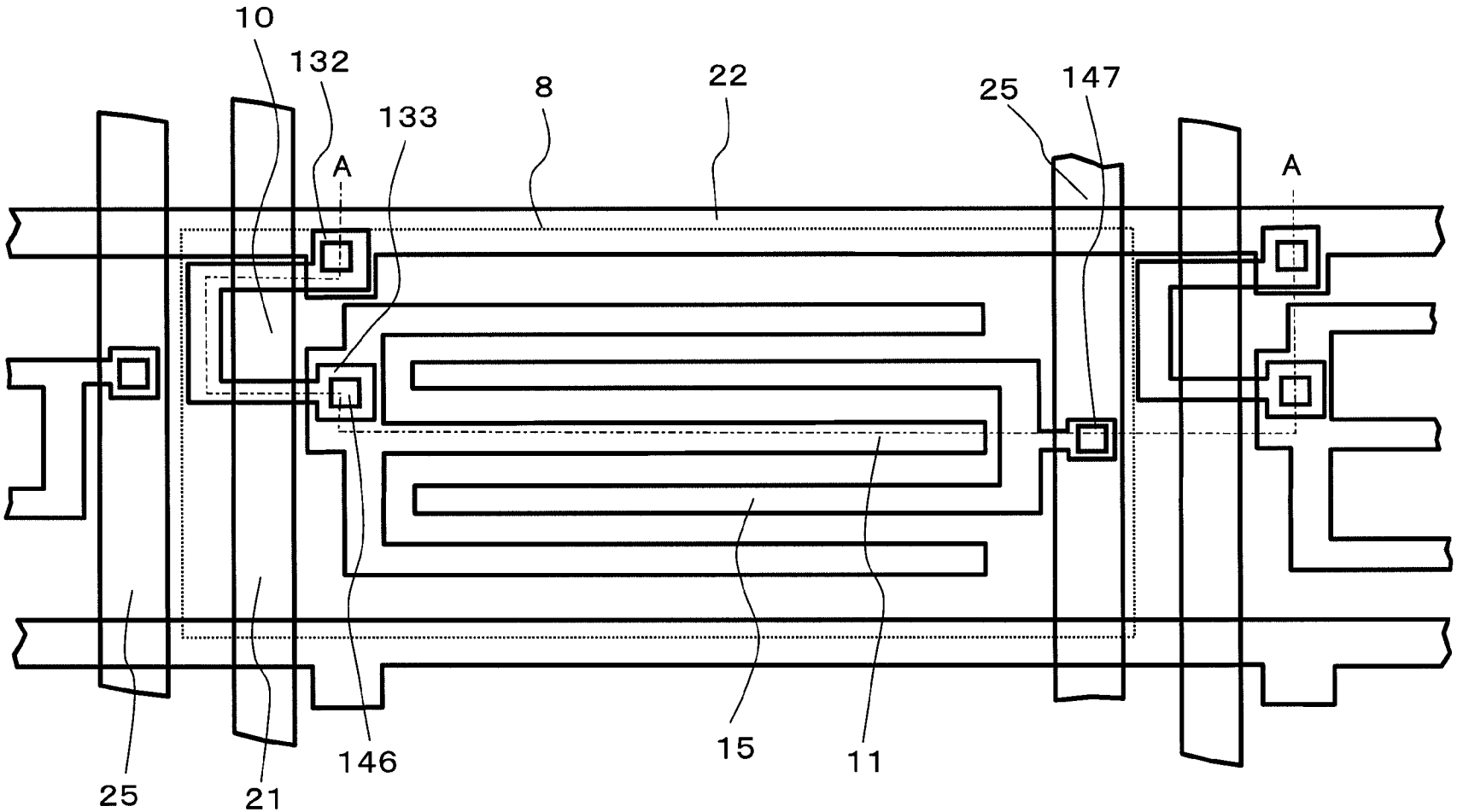
FIG. 2 is a plan view schematically showing a pixel contained in the liquid crystal display device according to the embodiment of the invention.
Figure 3:
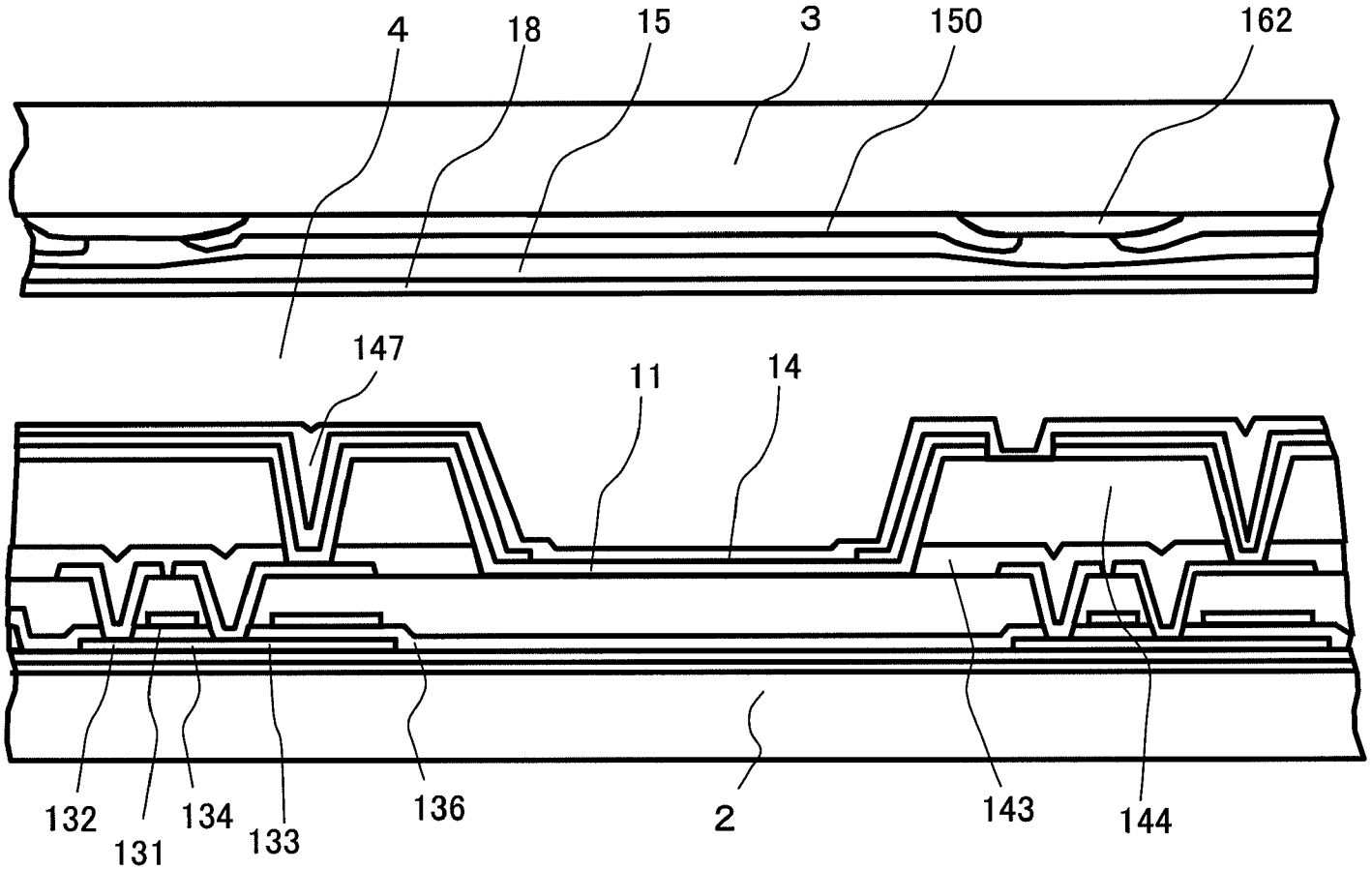
FIG. 3 is a cross-sectional view schematically showing the pixel contained in the liquid crystal display device according to the embodiment of the invention.

FIG. 2 is a plan view of the pixel unit 8 of the liquid crystal display device 1. FIG. 3 is a cross-sectional view taken along a line A-A in FIG. 2. FIGS. 2 and 3 illustrate the pixel unit 8 of the in-plane switching mode liquid crystal panel. As shown in FIG. 2, the pixel unit 8 is provided on the TFT substrate 2 in the area surrounded by the scanning signal line 21, the counter electrode signal line 25, and the image signal line 22.

The switching element 10 (hereinafter referred to as thin film transistor or TFT as well) is disposed in the vicinity of the cross point of the scanning signal line 21 and the image signal line 22. As discussed above, the TFT 10 is turned on in response to the gate signal supplied via the scanning signal line 21, and writes the image signal supplied via the image signal line 22 to the pixel electrode 11.

The pixel electrode 11 and the counter electrode 15 are alternately disposed in a comb-shape. The orientation direction of the liquid crystal molecules is changed by the phase difference produced between the image signal supplied to the pixel electrode 11 and the counter voltage supplied to the counter electrode 15 to control the intensity of the transmission light.

FIG. 3 illustrates the cross-sectional structure of the liquid crystal display panel 1. As discussed above, the TFT substrate 2 and the color filter substrate 3 are disposed opposed to each other. The liquid crystal constituent 4 is retained between the TFT substrate 2 and the color filter substrate 3. The seal material (not shown) is provided on the peripheries of the TFT substrate 2 and the color filter substrate 3. The TFT substrate 2, the color filter substrate 3, and the seal material constitute a container having a narrow clearance, and the liquid crystal constituent 4 is sealed between the TFT substrate 2 and the color filter substrate 3. Orientation films 14 and 18 control the orientation of the liquid crystal molecules.

A color filter 150 is provided for each of red (R), green (G), and blue (B) on the color filter substrate 3, and black matrix 162 is disposed on each boundary of the respective color filters 150 for light shielding.

At least a part of the TFT substrate 2 is constituted by transparent glass, resin, or other materials. A base film is formed on the TFT substrate 2, and a semiconductor layer 134 made of polysilicon is provided on the base film.

A gate insulation film 136 is formed on the semiconductor layer 134, and a gate electrode 131 is provided on the gate insulation film 136. As discussed above, the scanning signal line 21 is disposed on the TFT substrate 2, but a part of the scanning signal line 21 form the gate electrode 131. The scanning signal line 21 is constituted by a layer chiefly made of chrome (Cr) or zirconium, and a multilayer film chiefly made of aluminum (Al). The side of the scanning signal line 21 slopes such that the line width expands from the upper surface toward the lower surface on the TFT substrate side.

Impurity is injected to both ends of the semiconductor layer 134, and drain area 132 and source area 133 are provided separately from each other. As discussed above, drain and source are switched according to potentials. In this embodiment, the one connected with the image signal line 22 is drain, and the one connected with the pixel electrode 11 is source.

The image signal line 22 is constituted by multilayer films as two layers chiefly made of alloy of molybdenum (Mo) and chrome (Cr), or chiefly made of molybdenum (Mo) or tungsten (W), between which two layers a layer chiefly made of aluminum (Al) is sandwiched. An inorganic insulation film 143 and an organic insulation film 144 are provided in such positions as to surround the TFT 30. The source area 133 is connected with the pixel electrode 11 via a through hole 146 formed on the inorganic insulation film 143 and the organic insulation film 144.

The inorganic insulation film 143 may be formed by silicon nitride or silicon oxide, and the organic insulation film 144 may be formed by organic resin film. The surfaces may be relatively smooth, or may have concaves and convexes.

The pixel electrode 11 and the counter electrode 15 are constituted by transparent conductive films. The transparent conductive films are formed of light transmissive conductive layers made of ITO (indium tin oxide), ITZO (indium tin zinc oxide), IZO (indium zinc oxide), ZnO (zinc oxide), SnO (stannous oxide), In2O3 (indium oxide), or other material.

The layer chiefly made of chrome discussed above may be made of chrome only or alloy of chrome and molybdenum (Mo) or the like. The layer chiefly made of zirconium may be made of zirconium only or alloy of zirconium and molybdenum or the like. The layer chiefly made of tungsten may be made of tungsten only or alloy of tungsten and molybdenum or the like. The layer chiefly made of aluminum may be made of aluminum only or alloy of aluminum and neodymium or the like.

Figure 4:
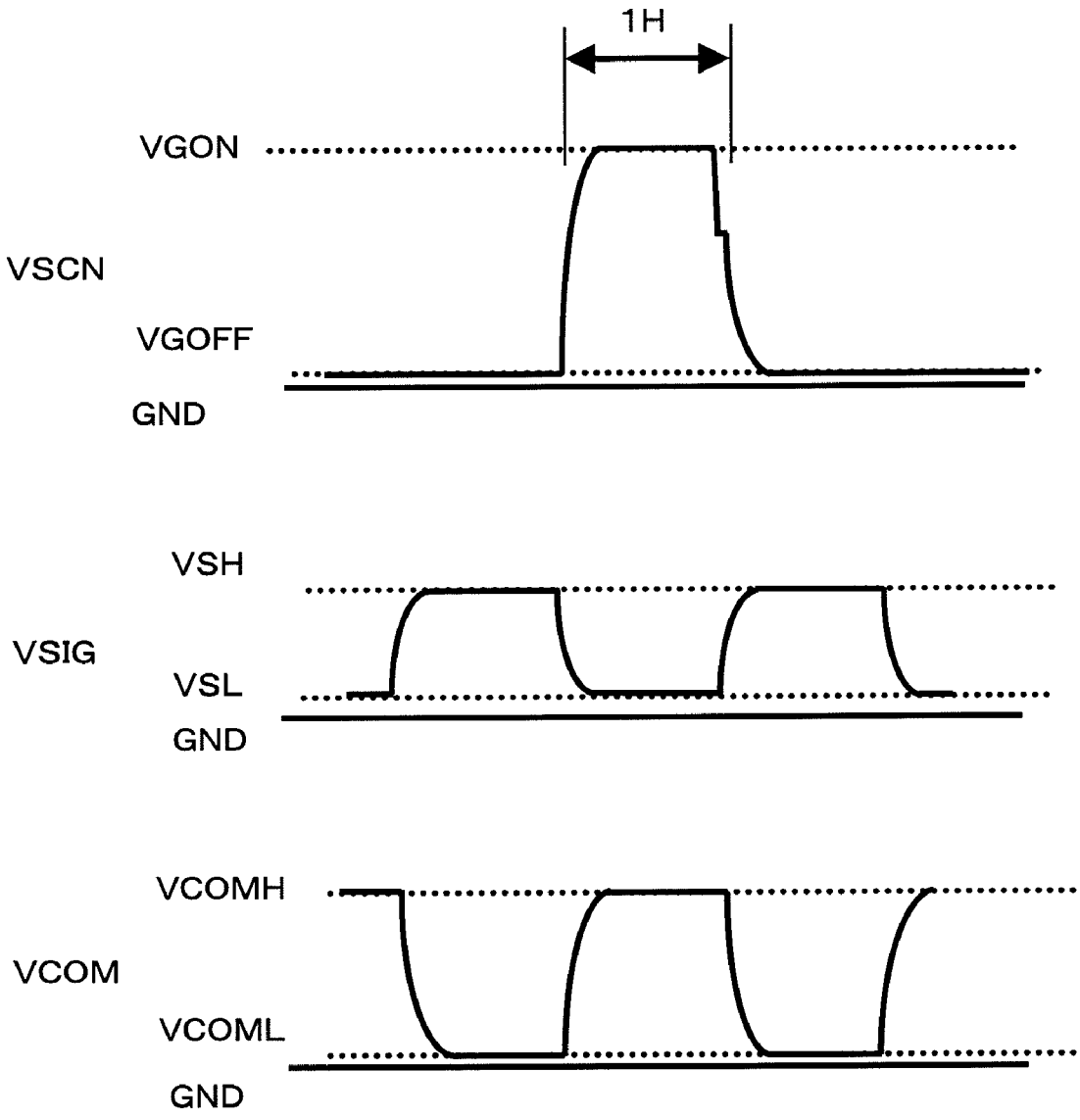
FIG. 4 is a timing chart showing driving waveforms used in the liquid crystal display device according to the embodiment of the invention.

FIG. 4 shows a scanning signal VSCN, an image signal VSIG, and a counter voltage VCOM used in so-called counter voltage inverting drive system which inverts the counter voltage VCOM supplied to the counter electrode 15 on a fixed cycle.

The scanning signal VSCN shown in FIG. 4 indicates a scanning signal outputted to an arbitrary line of the scanning signal lines 21. As illustrated in FIG. 4, the period during which the scanning signal VSCN supplied to the scanning signal 21 has high voltage is called one horizontal scanning period (1H). According to the counter voltage inverting drive system, the counter voltage VCOM is inverted for each one horizontal scanning period. In the counter voltage inverting drive system, the potential difference between the image signal VSIG and the counter voltage VCOM can be increased even when the amplitude of the image signal VSIG is small. Accordingly, low voltage driving and power consumption reduction can be achieved.

The sign VSH of the image signal NSIG indicates positive grey scale voltage supplied to the pixels as a signal having positive polarity with respect to the counter voltage VCOM. The sign VSL indicates negative grey scale voltage having negative polarity with respect to the counter voltage VCOM.

The sign VCOMH corresponds to counter electrode high voltage, and the sign VCOML corresponds to counter electrode low voltage. The counter voltage VCOM is inverted between the high voltage VCOMH and the low voltage VCOML for each one horizontal scanning period (1H).

The sign VGON of the scanning signal VSCN is high voltage of the scanning signal VSCN for turning on the thin film transistor (TFT) 10 of the pixel unit, and requires higher voltage than the maximum of the positive grey scale voltage VSH by the amount of a threshold voltage. The sign VGOFF is low voltage for turning off the thin film transistor 10, and requires lower voltage than the minimum of the negative grey scale voltage VSL by the amount of a threshold voltage or more.

Figure 5:
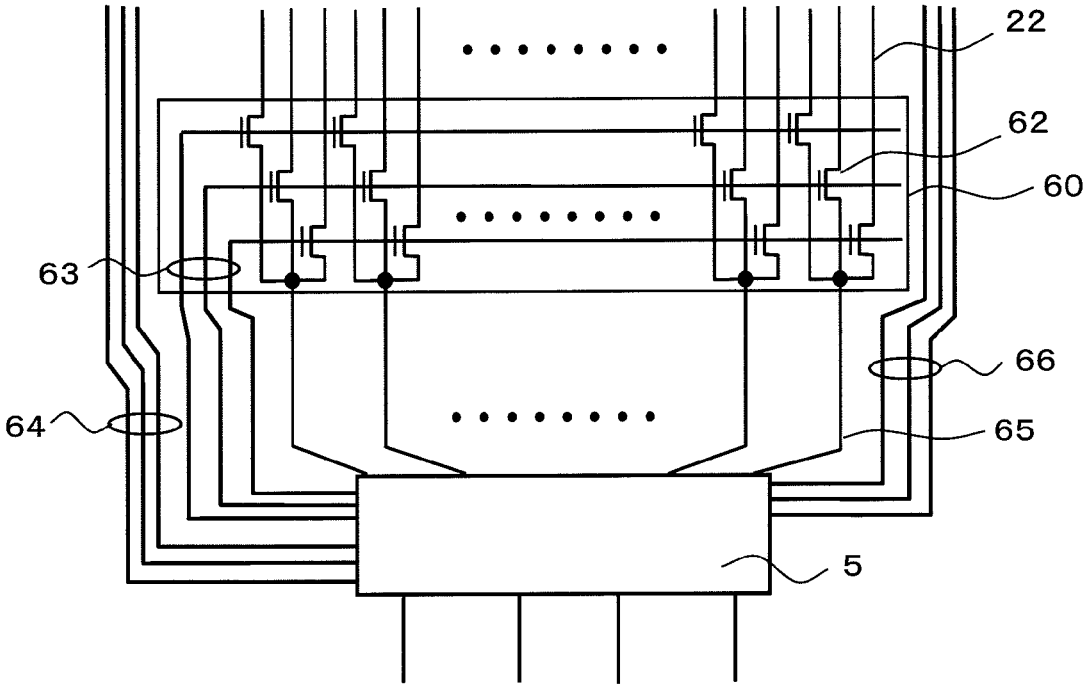
FIG. 5 schematically illustrating a driving circuit of the liquid crystal display device according to the embodiment of the invention.

The distributing circuit 60 is now described with reference to FIG. 5. FIG. 5 chiefly shows the distributing circuit 60 provided on the TFT substrate 2 and the driver circuit 5 mounted on the TFT substrate 2, but does not show other structures.

Image signal output lines 65 are inputted to the distributing circuit 60 from the driver circuit 5. Switching elements 62 are provided on the distributing circuit 60, and input electrodes and output electrodes of the switching elements 62 are connected with the image signal output lines 65 and image signal lines 22, respectively. Distributing control lines 63 are connected with the control electrodes of the switching elements 62.

One image signal output lines 65 of the driver circuit 5 is connected with three switching elements 62. A set of three switching elements 62 connected in parallel are joined to three distributing control lines 63.

The driver circuit 5 divides one horizontal scanning period into three parts, and sequentially outputs image signals to the three image signal lines 22. The image signals to be outputted are distributed to the respective image signal lines 22 by sequentially turning on the switching elements 62.

The distributing circuit 60 can decrease the number of the image signal output lines 65 of the driver circuit 5 to one third, and thus increase connection reliability of the image signal output lines 65. Moreover, the distributing circuit 60 can reduce the circuit scale of the driver circuit 5.

Figure 6:
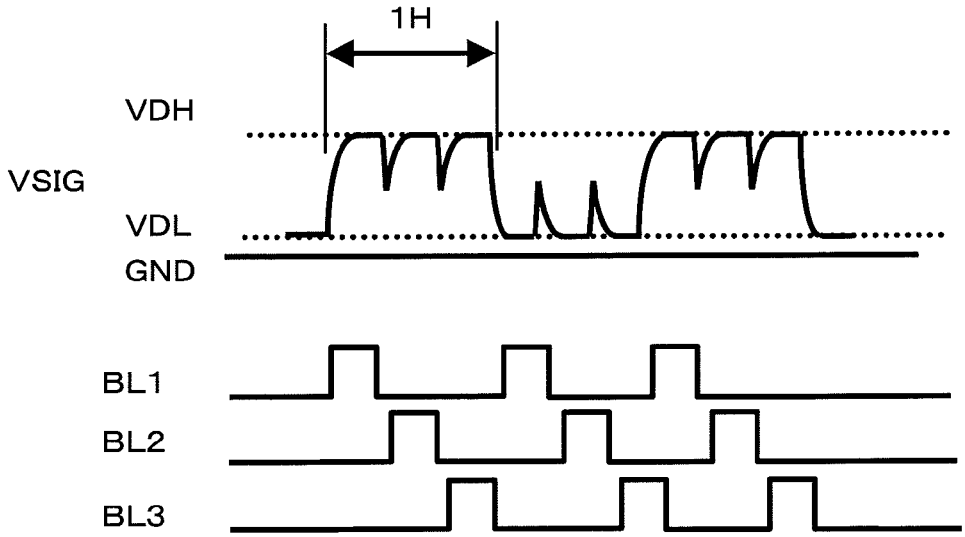
FIG. 6 is a timing chart showing driving waveforms of the liquid crystal display device according to the embodiment of the invention.

As shown in the timing chart in FIG. 6, the image signal VSIGN of the three image signal lines 22 is outputted to the image signal output lines 65 from the driver circuit 5 for each of three divided parts of one horizontal scanning period 1H. Also, distribution signals BL1, BL2, and BL3 are sequentially outputted to the distributing control lines 63 from the driver circuit 5 to supply image signals to three image signal lines 22.

A shift register circuit included in the scanning line driving circuit 51 and the counter electrode line driver circuit 52 is now described with reference to FIGS. 7 and 8.

Figure 7:
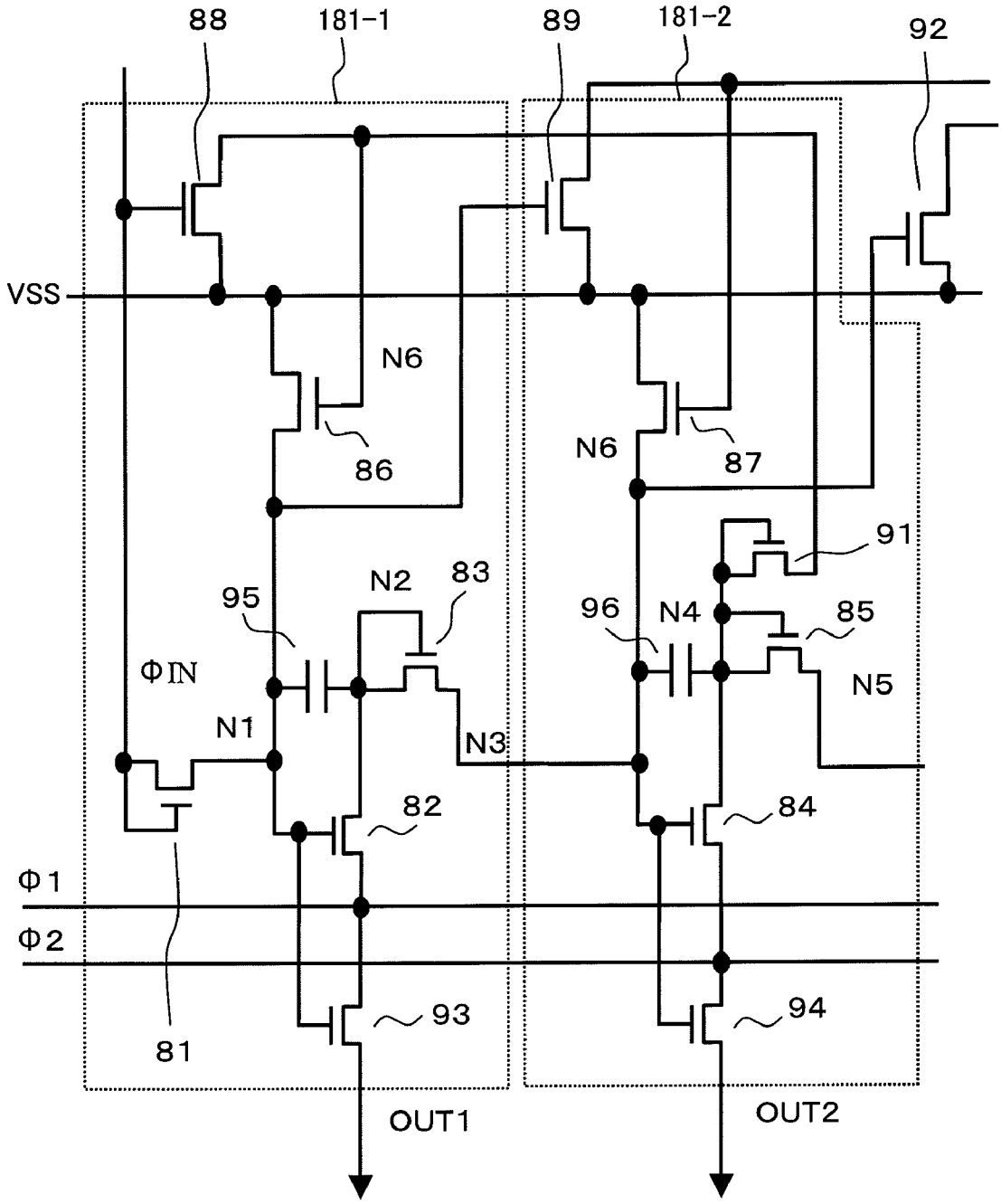
FIG. 7 is a circuit diagram schematically showing a driving circuit of the liquid crystal display device according to the embodiment of the invention.
Figure 8:
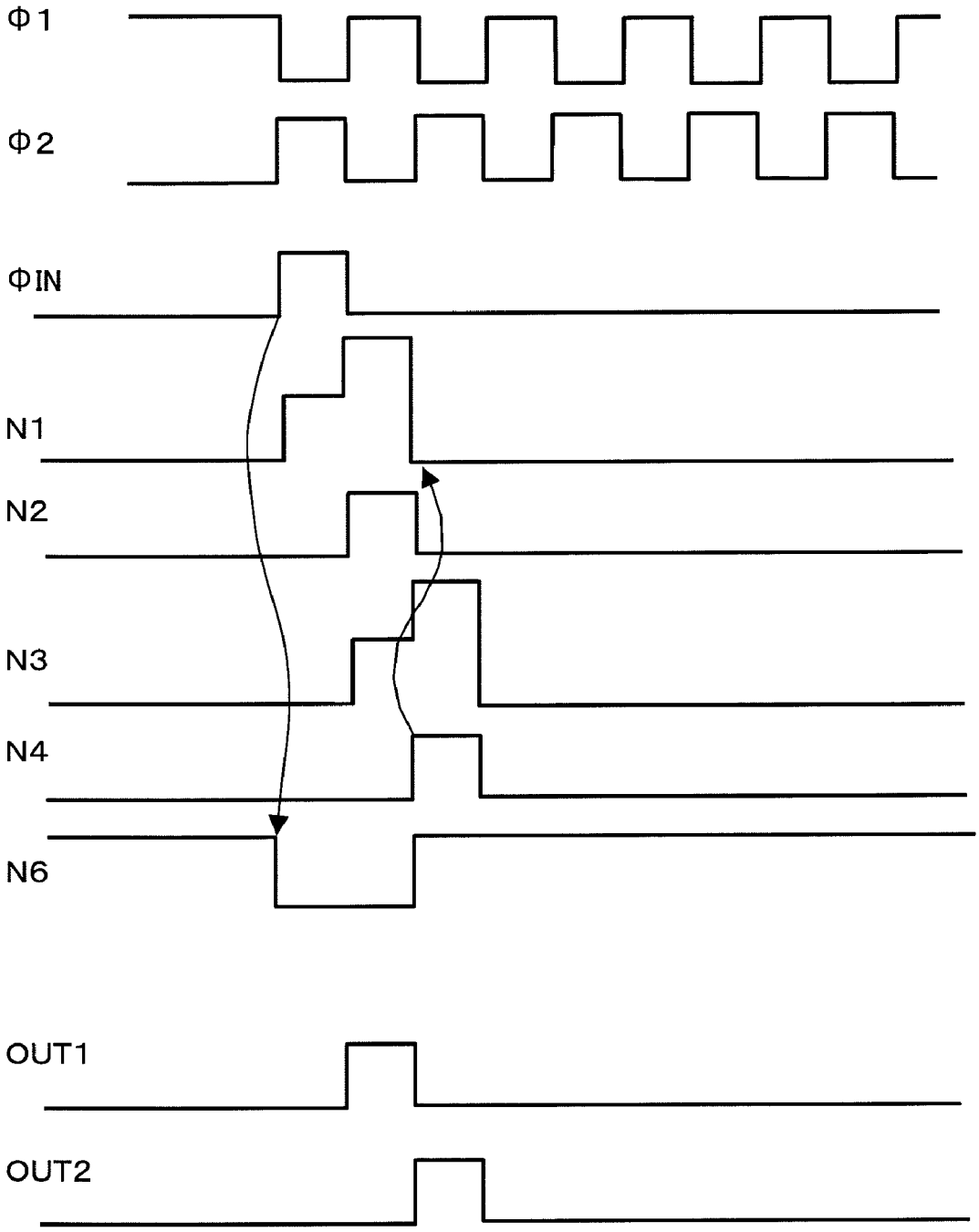
FIG. 8 is a timing chart showing driving waveforms of the liquid crystal display device according to the embodiment of the invention.

FIG. 7 is a circuit diagram showing the outline of the shift register circuit having a first shift register circuit 181-1 and a second shift register circuit 181-2. FIG. 8 is a timing chart of the shift register circuit, showing sequential outputs of signals from outputs OUT1 and OUT2 according to clocks Φ1 and Φ2.

When a start pulse ΦIN is inputted to an input transistor 81, voltage of node N1 increases in response to the start pulse ΦIN. When the voltage of the node N1 exceeds a threshold of a transistor 82, the transistor 82 is turned on.

At this time, a transistor 86 is in OFF condition, and the node N1 is thus under floating state. In this case, the voltage of the node N1 is increased by a capacity 95 produced between the node N1 and a node N2 in accordance with the change of the clock Φ1 from low voltage to high voltage under the ON condition of the transistor 82. As a result, the voltage applied to the gate electrode of the transistor 82 becomes sufficiently larger than the clock Φ1 (in comparison with the threshold voltage), allowing the voltage of the node N2 to be equivalent to high voltage of the clock Φ1.

When the voltage of the node N2 is equivalent to high voltage of the clock Φ1, voltage of a node N3 also increases to high voltage via a transistor 83. As a result, a subsequent transistor 84 is turned on.

The gate electrode of a transistor 93 is similarly connected with the node N1, and high voltage of the clock Φ1 is outputted from the output electrode OUT1.

When the clock Φ2 changes from low voltage to high voltage under ON condition of the subsequent transistor 84, the voltage of the node N3 is increased to a sufficiently larger voltage than the clock Φ2 by a capacity 96 produced between the node N3 and a node N4. As a result, the voltage of the node N4 becomes equivalent to high voltage of the clock Φ2.

When the voltage of the node N4 is equivalent to high voltage of the clock Φ2, high voltage is outputted from the output OUT2. In this case, voltage of a node N5 is increased to high voltage via a transistor 85, and the ON condition is transmitted to the subsequent transistor.

At this time, voltage of a node N6 becomes high voltage under ON condition of a transistor 91. As a result, high voltage is transmitted to the control electrode of the transistor 86, and the transistor 86 is turned on. In this condition, continuity between the node N1 and power source voltage VSS is produced, and the voltage of the node N1 becomes low voltage supplied from the voltage VSS.

Then, the ON condition of the node N6 is maintained, and the voltage of the node N1 is stabilized at low voltage. Thus, faulty operation of the transistor 82 or the like caused by noise can be prevented. At the start of the subsequent frame, a transistor 88 is turned on by the start pulse ΦIN, and low voltage is supplied to the control electrode of the transistor 86. In this condition, the node N1 is brought to floating state. Operations performed for the transistor 88 are also carried out for the transistors 89 and 92.

By incorporating this shift register in the scanning line driving circuit 51 and the counter electrode line driver circuit 52, a compact and low power consumption type circuit can be provided.

Figure 9:
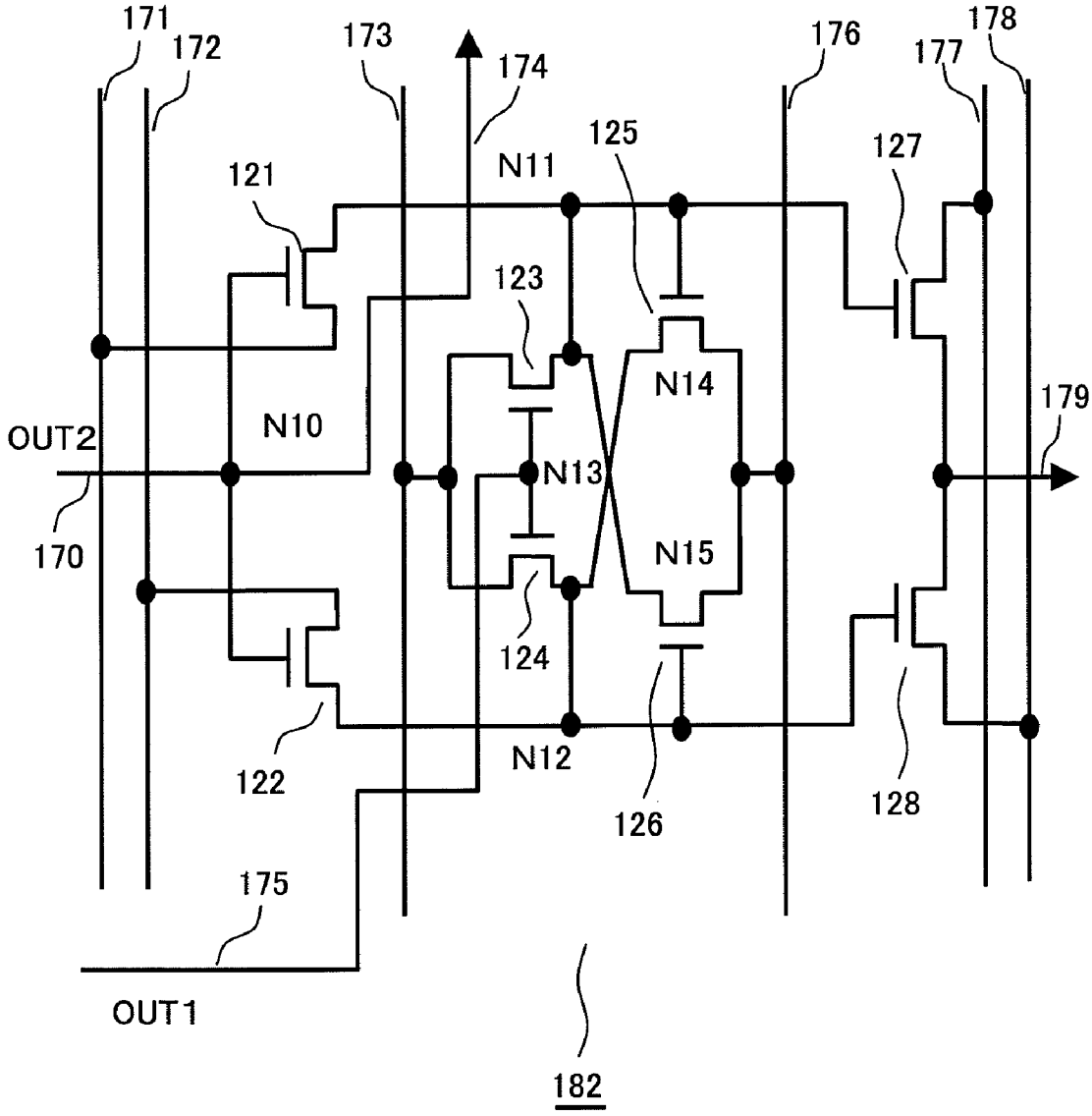
FIG. 9 is a circuit diagram schematically showing a driving circuit of the liquid crystal display device according to the embodiment of the invention.
Figure 10:
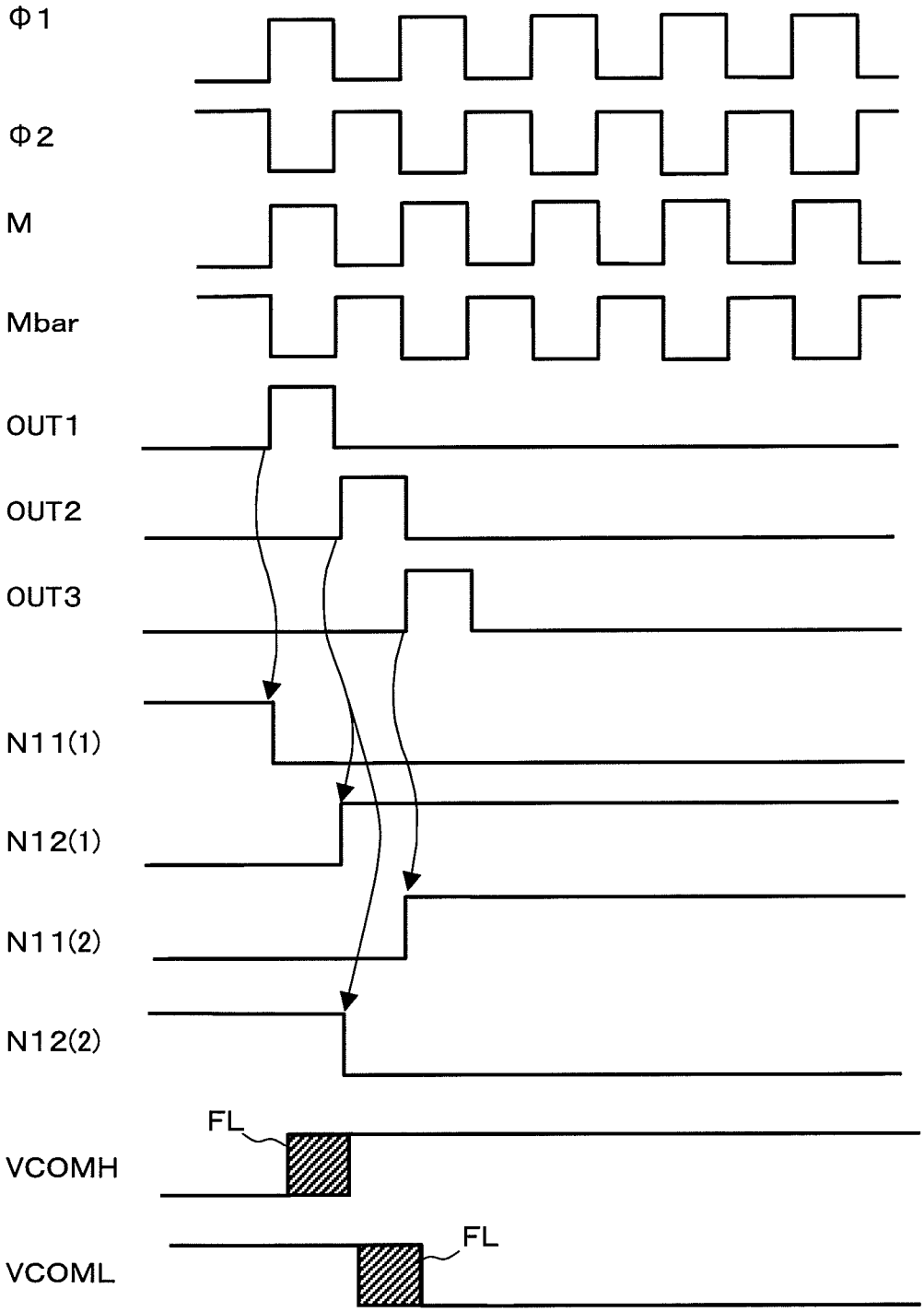
FIG. 10 is a timing chart showing driving waveforms of the liquid crystal display device according to the embodiment of the invention.

The operation of the counter electrode line driver circuit 52 is now described with reference to FIGS. 9 and 10. FIG. 9 illustrates a general structure of an alternating driving circuit 182 of the counter electrode line driver circuit 52, and FIG. 10 is a timing chart showing the operation of the counter electrode line driver circuit 52.

The output of the shift register circuit discussed above is inputted to the counter electrode line driver circuit 52 shown in FIG. 9 from the left side in the figure. The output of the shift register circuit shifts upward from the lower position in the figure. For example, the output OUT2 is inputted to an input electrode 170, and the output OUT1 is inputted to an input electrode 175.

Initially, high voltage is inputted to the input electrode 175 by the output OUT1 received from the previous section. As a result, the voltage of a node N13 becomes high. Under high voltage of the node N13, transistors 123 and 124 are turned on, and continuity between a power source voltage line 173 and nodes N14 and N15 is produced. Since low voltage (VSS) is supplied to the power source voltage line 173, voltages of the nodes N14 and N15 are low.

Similarly, voltages of a node N11 connected with the node N14 and a node N12 connected with the node N15 become low, and thus transistors 127 and 128 are turned off. At this time, an output electrode 179 is in floating condition FL.

Then, the output OUT2 is inputted to the input electrode 170, and voltage of a node N10 becomes high. Thus, transistors 121 and 122 are turned on. As a result, both continuities between an alternating current driving signal line 171 and the node N11 and between an alternating current driving signal line 172 and the node N12 are produced.

An alternating current signal M shown in FIG. 10 is supplied to the alternating current driving signal line 171, and an alternating current signal Mbar is supplied to the alternating current driving signal line 172. The phases of the alternating current signal M and the alternating current signal Mbar are reversed. Thus, voltage of the node N12 becomes low when voltage of the node N11 is high.

Under high voltage of the node N11 and low voltage of the node N12, ON condition of the transistor 127 and OFF condition of the transistor 128 are produced. In this case, continuity between an output electrode 179 and a power source voltage line 177 is provided, but continuity between the output electrode 179 and a power source voltage line 178 is cut off.

Counter electrode high voltage VCOMH is supplied to the power source voltage line 177, and counter electrode low voltage VCOML is supplied to the power source voltage line 178. The output electrode 179 is connected with the counter electrode signal line 25. Thus, the counter electrode high voltage VCOMH is outputted to the counter electrode signal line 25 when the voltage of the node N11 is high. On the other hand, under high voltage of the node N12 and low voltage of the node N11, the counter electrode low voltage VCOML is outputted to the counter electrode signal line 25.

After this step, the voltage of the node N11 is kept high even when the output OUT2 becomes low voltage. Also, low voltage (VSS) is supplied to the node N14 from the power source voltage line 176 via the transistor 125, and the voltage of the node N12 becomes low and turns off the transistor 126. Thus, high voltages of the node N15 and N11 are maintained, and the counter electrode high voltage VCOMH is constantly outputted to the counter electrode signal line 25.

High voltage inputted through the input electrode 170 is outputted to the subsequent section via the output electrode 174. In this case, voltages of the node N14, node N11, node N15, and node N12 become low, and the subsequent transistors 127 and 128 are turned off.

A scanning circuit 53 including a combination of the shift register circuit 181 and the alternating current driving circuit 182 is now described with reference to FIG. 11.

The output OUT generated from the shift register circuit 181 is used as the scanning signal OUT to be outputted to the scanning signal line 21 as a scanning signal VSCN, and is also used for driving the alternating current driving circuit 182.

However, when the scanning signal line 21 and the counter electrode signal line 25 are simultaneously switched, potential fluctuation between the pixel electrode 11 and the counter electrode 15 may be produced. Thus, the voltage of the counter electrode is inverted before the scanning signal VSCN is outputted to the scanning signal line 21.

Figure 11:
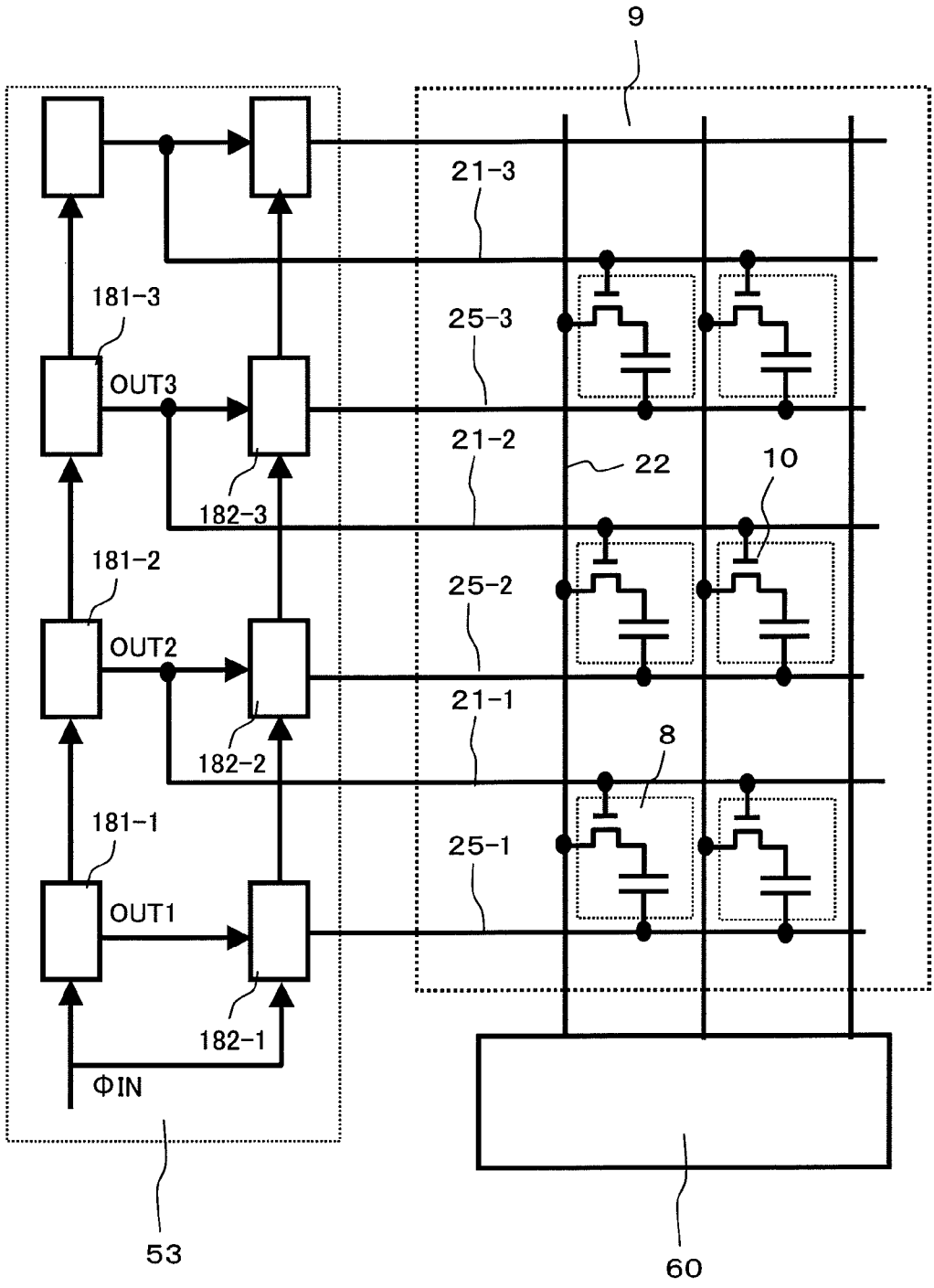
FIG. 11 is a circuit diagram showing a driving circuit of the liquid crystal display device according to the embodiment of the invention.
Figure 12:
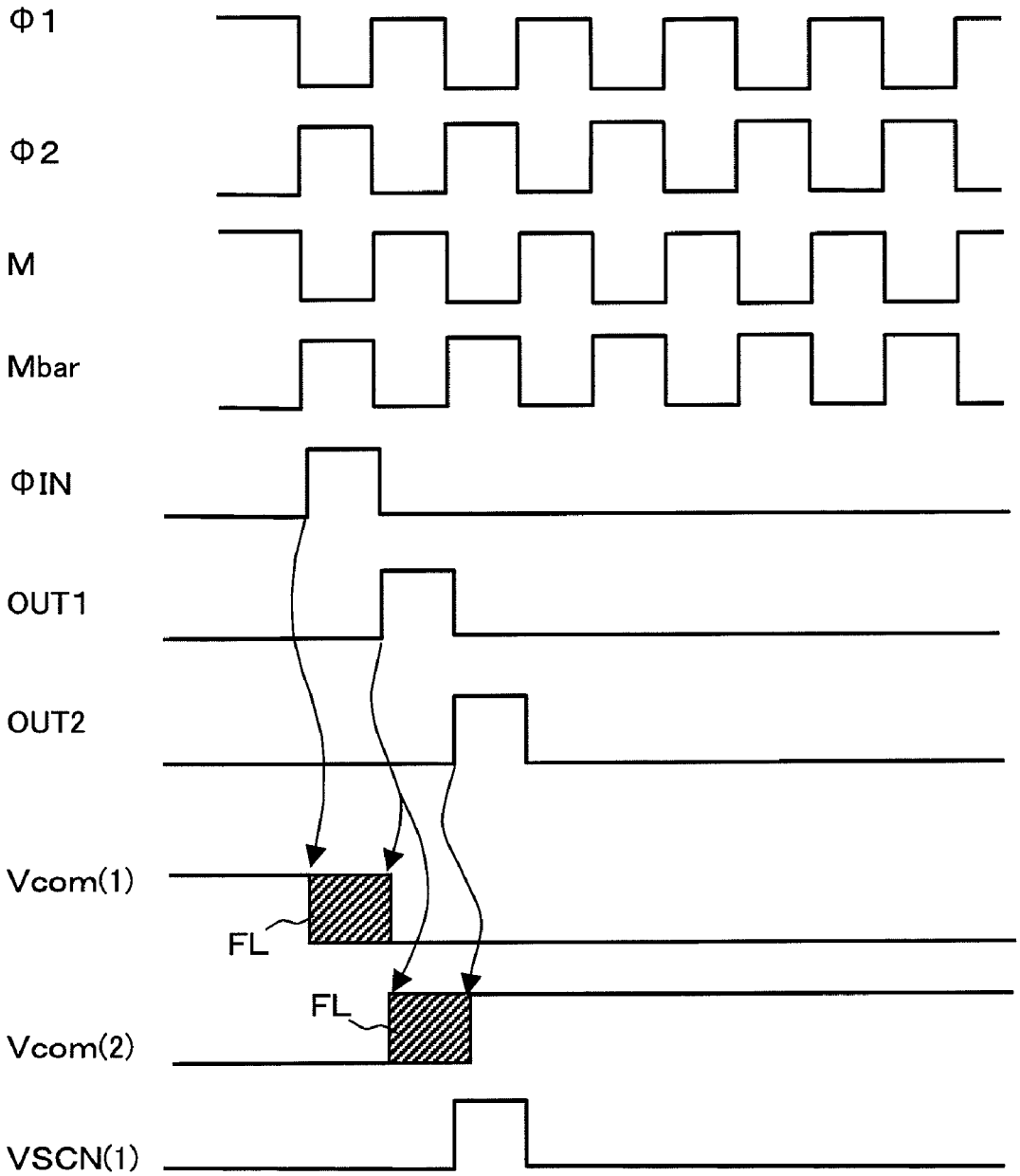
FIG. 12 is a timing chart showing driving waveforms of the liquid crystal display device according to the embodiment of the invention.

FIG. 12 is a timing chart showing the operation of the scanning circuit 53 shown in FIG. 11. A counter electrode signal line 25-1 is temporarily brought into floating condition FL by cutting off continuity between the transistor 127 and the transistor 128 (see FIG. 9) of an alternating current driving circuit 182-1 in response to the start pulse ΦIN inputted to a shift register 181-1.

Then, the clock signal Φ1 is outputted from the transistor 93 (see FIG. 7). As a result, high voltage is inputted to the alternating current driving circuit 182-1 from the shift register circuit 181-1 as the output OUT1. In case of low voltage of the alternating current signal M and high voltage of the alternating current signal Mbar, continuity between the transistor 128 and the power source voltage line 178 is produced. In this case, the counter electrode low voltage VCOML is outputted to the counter electrode signal 25-1 as counter electrode voltage Vcom(1).

Subsequently, continuity between the transistor 127 and the transistor 128 of the alternating current driving circuit 182-2 is cut off in response to the output OUT1 outputted from the shift register circuit 181-1. Thus, the counter electrode signal line 25-2 is temporarily brought into floating condition FL.

Then, the clock signal Φ2 is outputted from the transistor 94 (see FIG. 7). As a result, high voltage is inputted to the alternating current driving circuit 182-2 from the shift register circuit 181-2 as the output OUT2. In case of high voltage of the alternating current signal M and low voltage of the alternating current signal Mbar, continuity between the transistor 127 and the power source voltage line 177 is produced. In this case, the counter electrode high voltage VCOMH is outputted to the counter electrode signal 25-2 as counter electrode voltage Vcom(2).

At this time, the output OUT2 outputted from the shift register circuit 181-2 is used as a scanning signal VSCN(1) to be outputted to the scanning signal line 21-1.

Accordingly, the scanning circuit 53 has both the functions of the scanning signal line driving circuit 51 and the counter electrode line driver circuit 52, and thus outputs scanning signals and counter electrode signals by a small circuit scale structure.

Figure 13:
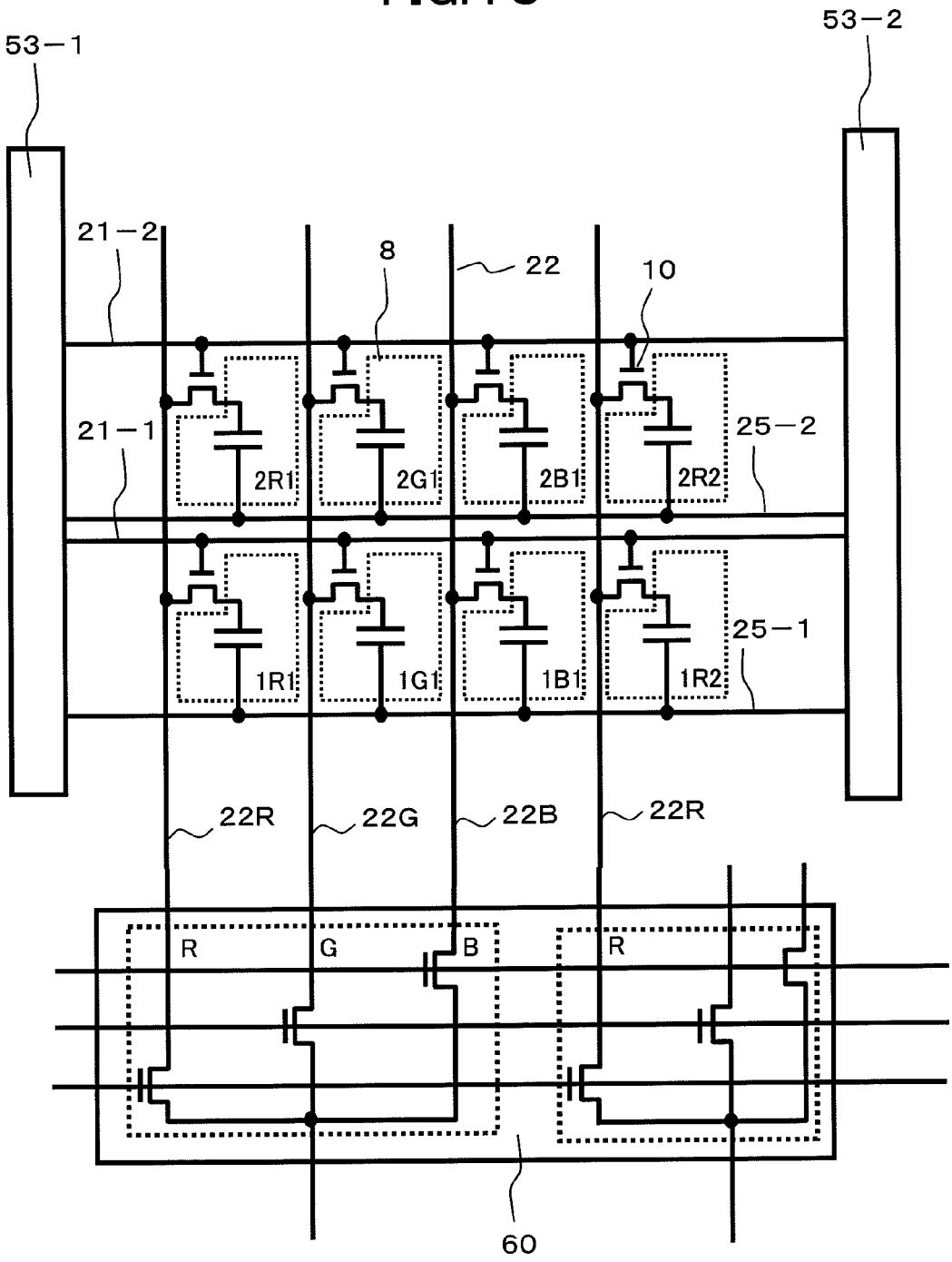
FIG. 13 is a circuit diagram schematically showing the liquid crystal display device according to the embodiment of the invention.

FIG. 13 is a block diagram showing a general structure of a liquid crystal display panel having the scanning circuits 53 capable of reducing the circuit scale at both ends of the scanning signal line 21 to supply scanning signals and counter electrode signals from both sides.

FIG. 13 chiefly shows the distributing circuit 60, the scanning circuit 53, and the pixel units 8, and does not contain other structures. Scanning circuits 53-1 and 53-2 supply scanning signals from both sides of the scanning signal line 21, and supply counter electrode signals from both sides of the counter electrode signal line 25. Since the area occupied by the scanning circuit 53 is small, two scanning circuits 53 can be provided on one substrate.

Figure 14:
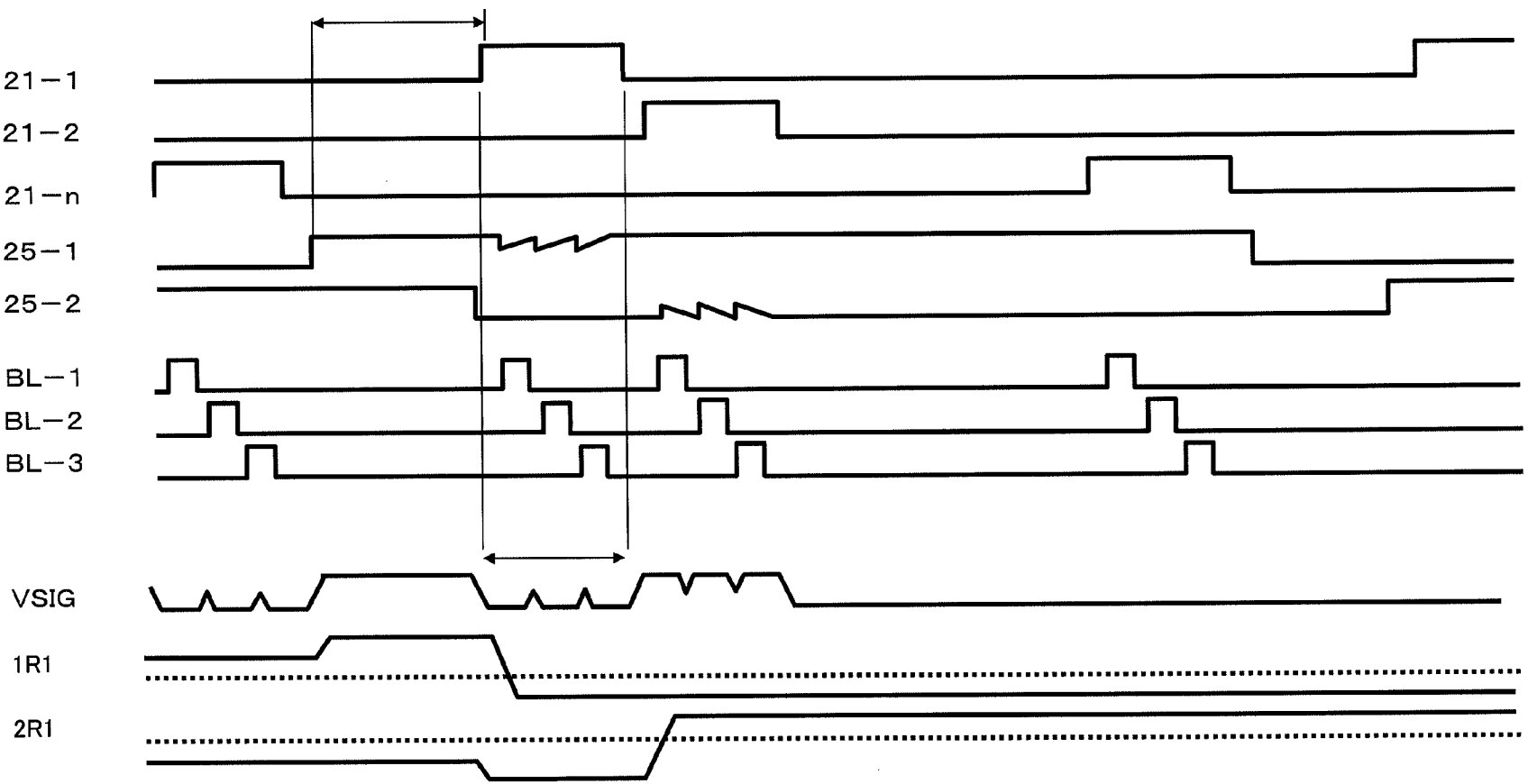
FIG. 14 is a timing chart showing waveforms of the liquid crystal display device according to the embodiment of the invention.

FIG. 14 is a timing chart of the circuits shown in FIG. 13. The voltage of the counter electrode signal line 25-1 becomes high one horizontal period before the period for outputting high voltage from the scanning signal line 21-1. Then, the thin film transistor 10 connected with the scanning signal line 21-1 is turned on under high voltage of the scanning signal line 21-1. As a result, the image signal VSIG is supplied to the image signal line 22 via the switching element 62 under ON condition in response to a distributing signal BL.

During the scanning period shown in FIG. 14, the polarity of the image signal VSIG is negative with respect to the counter electrode. In this case, the pixel electrode shifts to the negative side with respect to the counter electrode. Thus, the counter electrode producing capacity between itself and the pixel electrode shifts to the negative side, thereby generating noise shown in FIG. 14.

While the subsequent scanning signal line 21-2 is turned on, the polarity of the image signal VSIG is positive with respect to the counter electrode. In this case, the counter electrode shifts to the positive side, thereby causing noise generation.

According to the circuit shown in FIG. 13, scanning signals are supplied from both sides of the scanning signal line 21, and counter electrode signals are supplied from both sides of the counter electrode signal line 25. In this case, the driving capability of the scanning circuit 53 increases, which leads to reduction of noise generation.

However, when the voltage of the counter electrode signal line 25-1 is high, for example, during the period for scanning the scanning signal line 21-1 in the circuit shown in FIG. 13, the counter electrode high voltage VCOMH is supplied to the counter electrode signal line 25-1 from the power source voltage line 177 shown in FIG. 9. When the voltage of the counter electrode signal line 25-2 is low, for example, during the period for scanning the subsequent scanning signal line 21-2, the counter electrode low voltage VCOML is supplied to the counter electrode signal line 25-2 from the power source voltage line 178 shown in FIG. 9.

According to this structure, one counter electrode signal line 25 supplies the counter electrode high voltage VCOMH or the counter electrode low voltage VCOML to all the pixels constituting the line during the scanning period of the line.

According to the circuit shown in FIG. 11 or 13, the amount of charges to be supplied from the one counter electrode signal line 25 rises as the number of the horizontal pixels increases. Moreover, the period for scanning one line decreases as the number of the vertical pixels increases under the condition of the same frame frequency.

That is, more current needs to be supplied in a shorter time as the pixel number and resolution increase. Thus, reduction of wire resistance of the counter electrode signal line 25 is needed so as to decrease voltage fluctuation between the voltage written to the pixels and the counter electrode within a fixed range and retain high display quality.

However, the demand for maintaining the aperture ratio still exists, and therefore reduction of wire resistance only by expanding the wire width is not allowed. More specifically, the length of one counter electrode signal line 25 divided by the wire width increases when the wire width expands. In this case, the aperture ratio decreases. Thus, the wire width becomes small considering the requirement of the aperture ratio, and the resistance thus increases.

In order to cope with this limitation, two counter electrode signal lines 25 are operated during one scanning period according to this embodiment.

Figure 15:
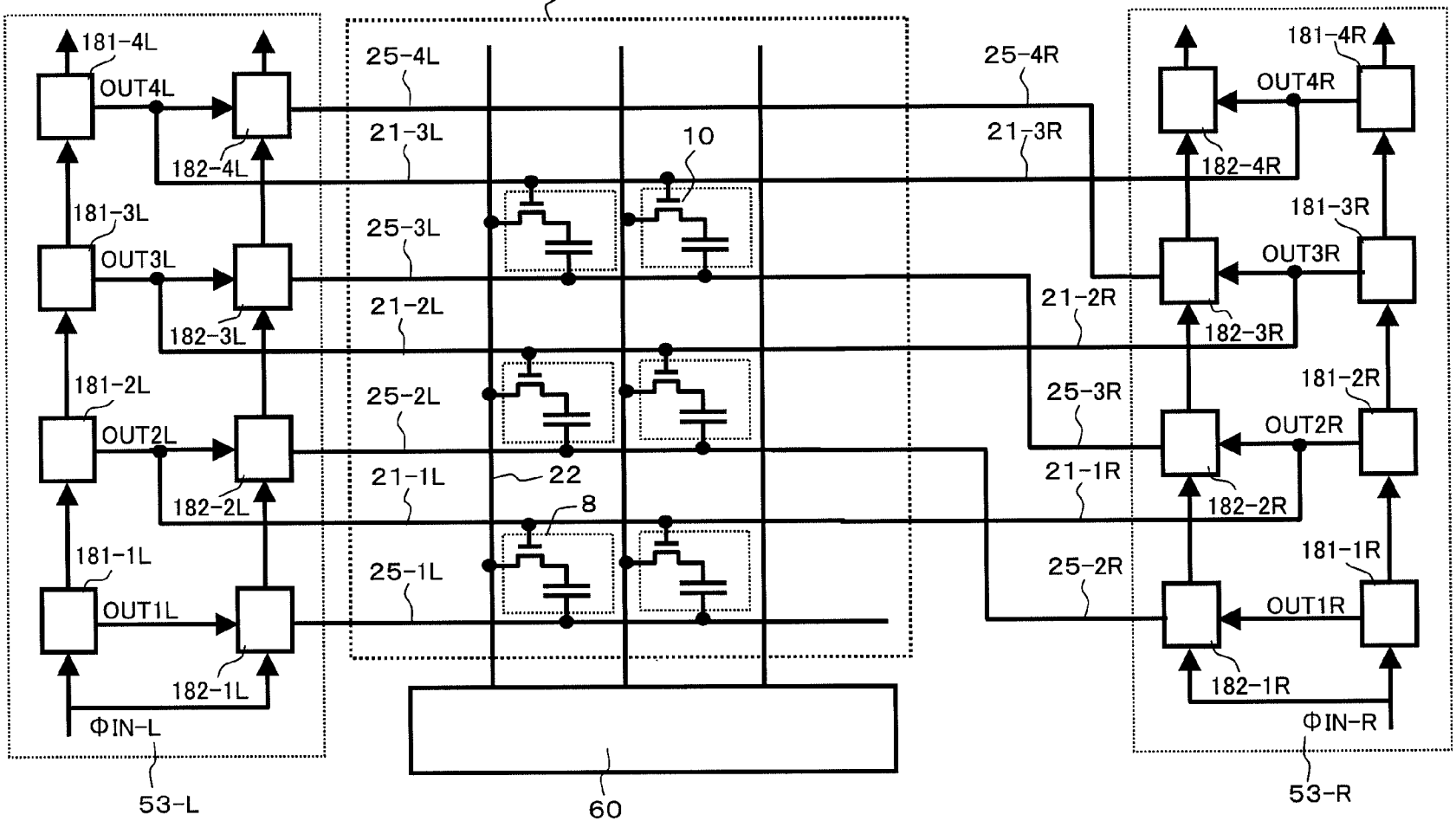
FIG. 15 a circuit diagram schematically showing the liquid crystal display device according to the embodiment of the invention.

According a circuit shown in FIG. 15, a scanning circuit 53-L inverts the polarity of the counter electrode signal line 25 from the left in the figure one scanning period before, and a scanning circuit 53-R inverts the polarity of the counter electrode signal line 25 one scanning period after.

Figure 16:
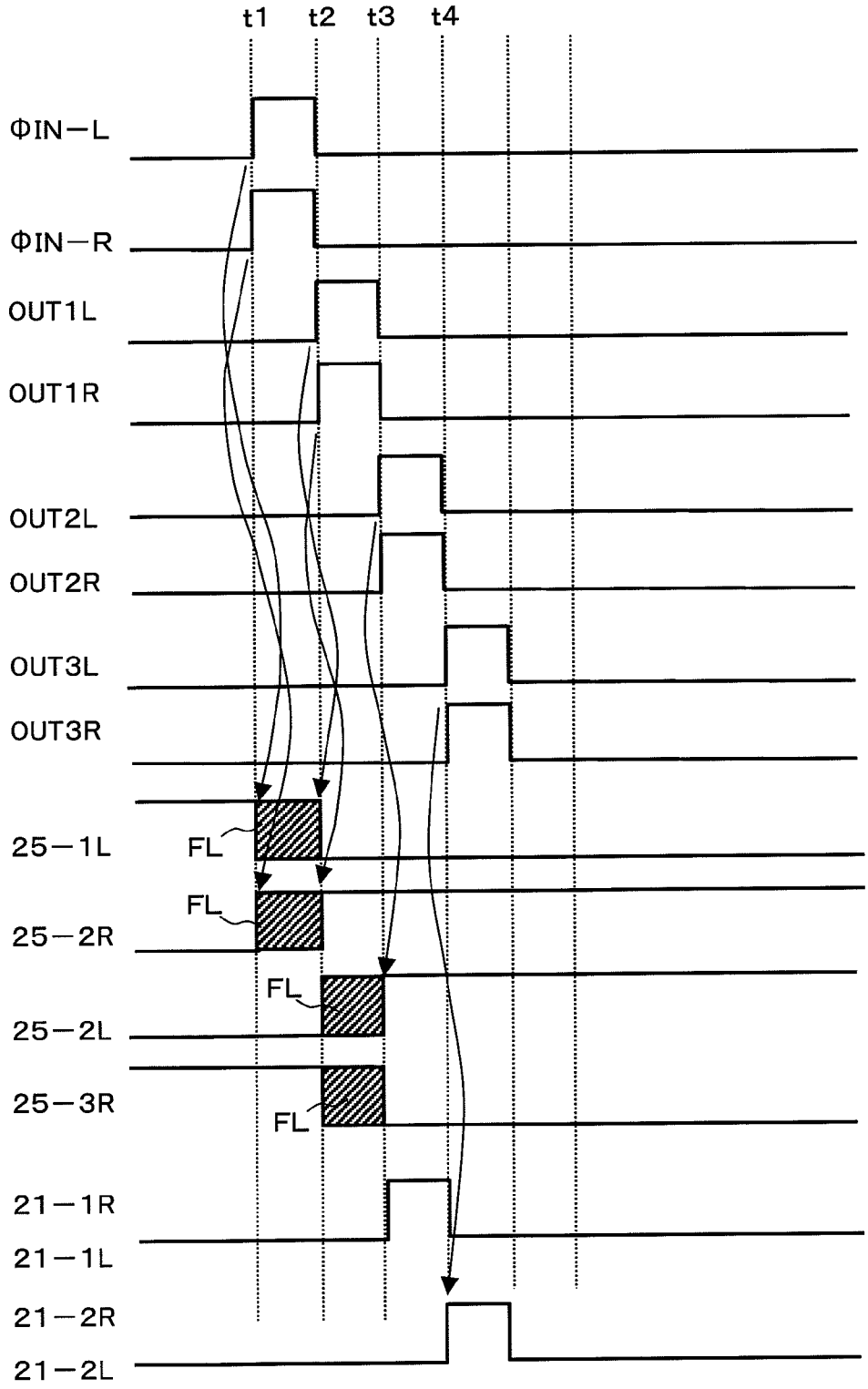
FIG. 16 is a timing chart showing waveforms of the liquid crystal display device according to the embodiment of the invention.

The circuit shown in FIG. 15 is now described in conjunction with a timing chart shown in FIG. 16. At time t1, a start pulse ΦIN-R is inputted to the scanning circuit 53-R simultaneously with the time for inputting a start pulse ΦIN-L to the scanning circuit 53-L. When the start pulse ΦIN-L is inputted to the scanning circuit 53-L, the alternating current driving circuit 182-1L is reset, and the output to the counter electrode signal line 25-1L is brought to floating condition FL.

Also, when the start pulse ΦIN-R is inputted to the alternating current circuit 182-1R at the time t1, the alternating current driving circuit 182-1R is reset. As a result, the output to the counter electrode signal line 25-R is brought to floating condition FL.

Then, output OUT1L is outputted from the shift register 181-1L, and output OUT1R is outputted from the shift register 181-1R at a time t2 one scanning period after the time t1. As a result, the counter electrode low voltage VCOML is outputted to the counter electrode signal line 25-1L, and the counter electrode high voltage VCOMH is outputted to the counter electrode signal line 25-2R.

Thus, counter electrode voltage having the polarity opposite to that of the previous frame is outputted to the counter electrode signal lines 25-1L and 25-2R at the time t2.

At the time t2, an alternating current driving circuit 182-2L is reset in response to the output OUT1L from the shift register circuit 181-1L, and the output to the counter electrode signal line 25-2L is brought to floating condition FL. Also, an alternating current driving circuit 182-3R is reset in response to the output OUT2R, and the output to a counter electrode signal line 23-3R is similarly brought to floating condition FL.

At a time t3 one scanning period after the time t2, the counter electrode high voltage VCOMH is outputted to the counter electrode signal line 25-2L in response to the output OUT2L from a shift register circuit 181-2L. Also, scanning signals are outputted to scanning signal lines 21-1L and 21-1R.

At a time t4 one scanning period after the time t3, scanning signals are outputted to the scanning signal lines 21-2L and 21-2R in response to the output OUT3L from a shift register circuit 181-3L and the output OUT3R from a shift register circuit 181-3R.

Thus, the counter electrode high voltage VCOMH is outputted to the counter electrode signal line 25-2R at the time t2, and the counter electrode high voltage VCOMH is outputted to the counter electrode signal line 25-2L at the time t3. Then, scanning signals are outputted to the scanning signal lines 21-2L and 21-2R. In this case, the scanning signals are outputted after sufficient drive of the counter electrode signal line 25. Accordingly, increase in the driving capability of the counter electrode signal line 25 and reduction of noise generated on the counter electrode signal line 25 can be achieved.

Figure 17:
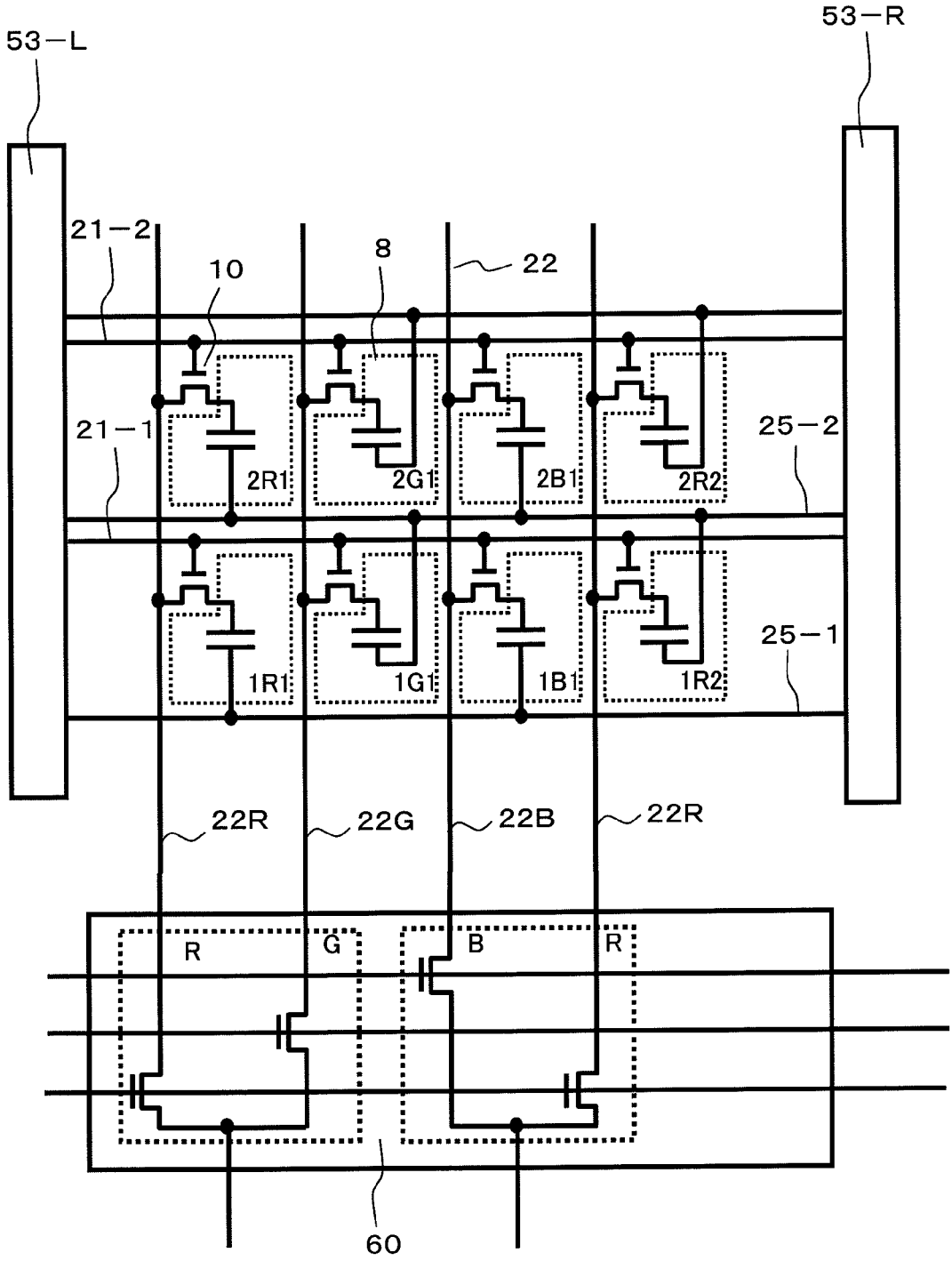
FIG. 17 is a circuit diagram schematically showing the liquid crystal display device according to the embodiment of the invention.

FIG. 17 illustrates lines of the pixel units 8 alternately connected with different counter electrode signal lines 25, and gate electrodes of the thin film transistors 10 of the pixel units 8 are connected with the same scanning line 21. In FIG. 17, a pixel indicated as 1R1 is connected with the counter electrode signal line 25-1, and a pixel indicated as 1G1 is connected with the counter electrode signal line 25-2.

According to this structure, the polarities of the image signals to be written to the pixel electrodes can be reversed by a pixel 1R1 and a pixel 1G1 to perform so-called dot-inverted drive. In the dot-inverted drive, the alternated units form a checkered pattern for each pixel. Thus, flickering on the screen caused by noise generated on the counter electrodes can be reduced.

According to the circuit shown in FIG. 17, the polarity of the counter electrode signal line 25-1 is initially inverted by the scanning circuit 53-L, and the polarity of the counter electrode signal line 25-2 is inverted by the scanning circuit 53-R. The counter electrode voltage outputted to the counter electrode signal line 25-1 and the counter electrode voltage outputted to the counter electrode signal line 25-2 are reversed.

Then, the scanning signal is outputted to the scanning signal line 21-1. At this time, the counter electrode signal is supplied to the pixel 1R1 from the counter electrode signal line 25-1, and the counter electrode signal having the polarity opposite to that of the pixel 1R1 is supplied to the pixel 1G1. Thus, the polarities of the image signals of the pixels 1R1 and the pixel 1G1 are reversed.

According to the structure containing the line of the thin film transistors 10 described above, the gate electrodes of the thin film transistors 10 are connected with one scanning signal line 21, and the polarities of the two counter electrode signal lines 25 are inverted during one scanning period. In this case, image signals having different polarities can be written to the adjoining two pixels 8 by alternately connecting the counter electrodes to the counter electrode signal line 25-1 and the counter electrode signal line 25-2. Thus, noise generated when image signals having one polarity are inputted can be reduced.

The counter electrode signal line 25-2 supplies signals to the counter electrodes of the pixel 1G1 and 1R2 which contain the thin film transistors having the gate electrodes connected with the scanning signal line 21-1. The counter electrode signal line 25-2 also supplies signals to the counter electrodes of the pixels 2R1 and 2B1 which contain the thin film transistors having the gate electrodes connected with the subsequent scanning signal line 21-2.

More specifically, the counter electrode signal lines 25 supplies counter electrode voltage to half of the pixels in one line one scanning period before. In this case, the scanning period of pixels in one line is divided into two parts at the time of operation. Accordingly, the driving capability of the scanning circuit 53 increases to a level higher than the necessary level.

Moreover, during the operation of the distributing circuit 60 in the dot inverting drive, image signals having positive polarity with respect to the counter electrode voltage are outputted in the first half of one scanning period, and image signals having negative polarity are outputted in the second half after division of one scanning period into two parts.

Figure 18:
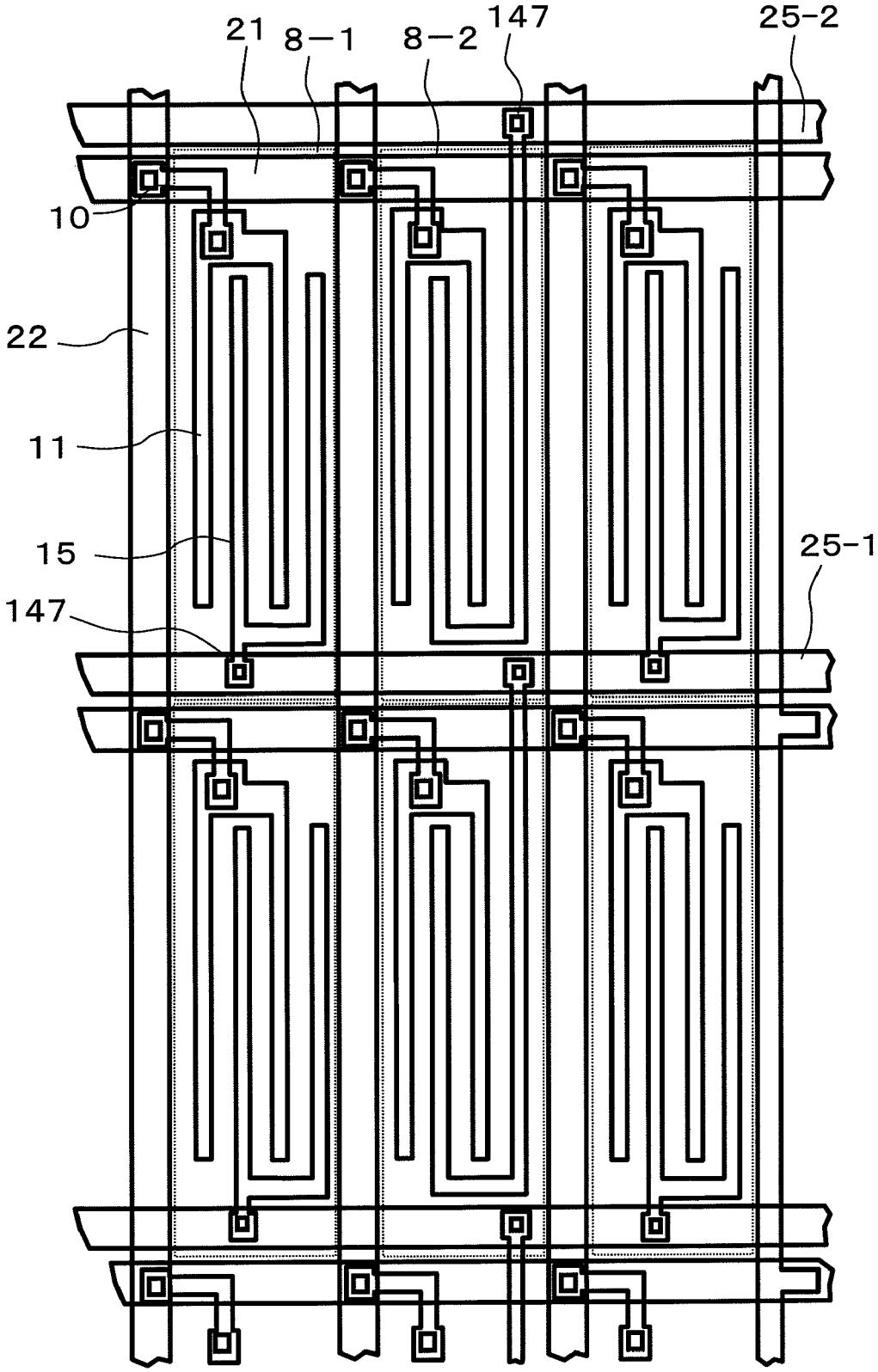
FIG. 18 is a plan view schematically showing the liquid crystal display device according to the embodiment of the invention.

FIG. 18 is a plan view of a general structure of the pixel unit in the circuit shown in FIG. 17. The counter electrode 15 of a pixel 8-1 is connected with the counter electrode signal line 25-1 via a through hole 147, and the counter electrode 15 of a pixel 8-2 is connected with the counter electrode signal line 25-2 via the through hole 147.

The counter electrode signal line 25 is disposed adjacent to the scanning signal line 21. Thus, the counter electrode 15 needs to override the scanning line 21 for connection when the counter electrode 15 is disposed on the same conductive layer. Accordingly, the counter electrode 15 is connected with the counter electrode signal line 25 via the through hole 147 formed on the insulation layer.

Figure 19:
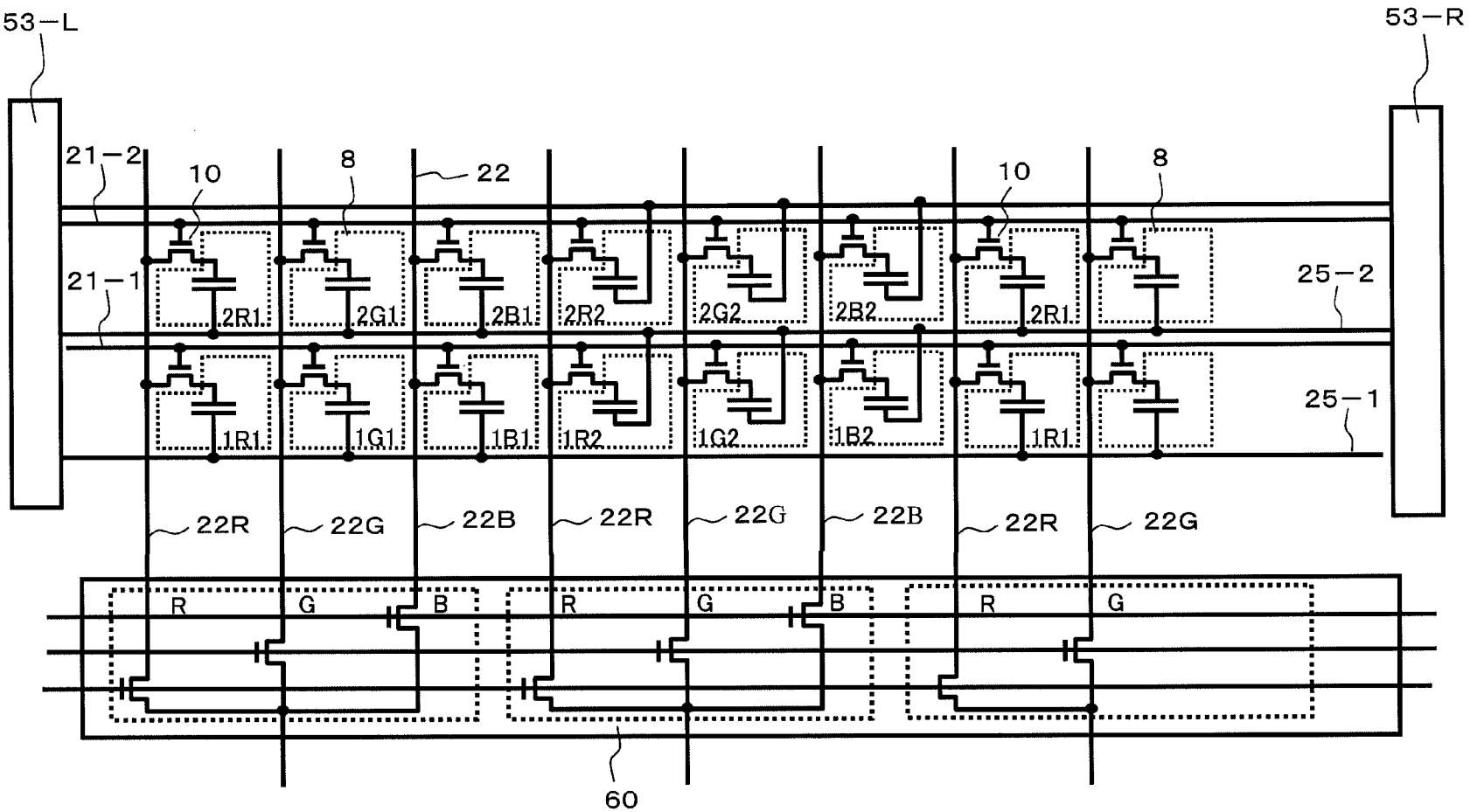
FIG. 19 is a circuit diagram schematically showing the liquid crystal display device according to the embodiment of the invention.

FIG. 19 illustrates a circuit containing sets of three pixels each set of which is alternately connected with the different counter electrode signal lines 25. The distributing circuit 60 has sets of RGB, and image signals having negative polarity are outputted to the pixels 1R2, 1G2 and 1B2 when image signal having positive polarity are outputted to the pixels 1R1, 1G1 and 1B1.

Counter electrode voltage is supplied to the counter electrodes 15 of the pixels 1R1, 1G1 and 1B1 from the counter electrode signal line 25-1. When image signals having positive polarity are outputted to the pixels 1R1, 1G1 and 1B1, for example, counter electrode voltage for positive polarity is supplied to the counter electrodes 15.

On the other hand, counter electrode voltage is supplied to the counter electrodes 15 of the pixels 1R2, 1G2 and 1B2 from the counter electrode signal line 25-2. When image signals having negative polarity are outputted to the pixels 1R2, 1G2 and 1B2, for example, counter electrode voltage for negative polarity is supplied to the counter electrodes 15.

According to the circuit structure shown in FIG. 19, the driver circuit 5 (see FIG. 1) outputs image signal having the same polarity to the distributing circuit 60 during one scanning period. Thus, burden on the driver circuit 5 can be reduced.

Figure 20:
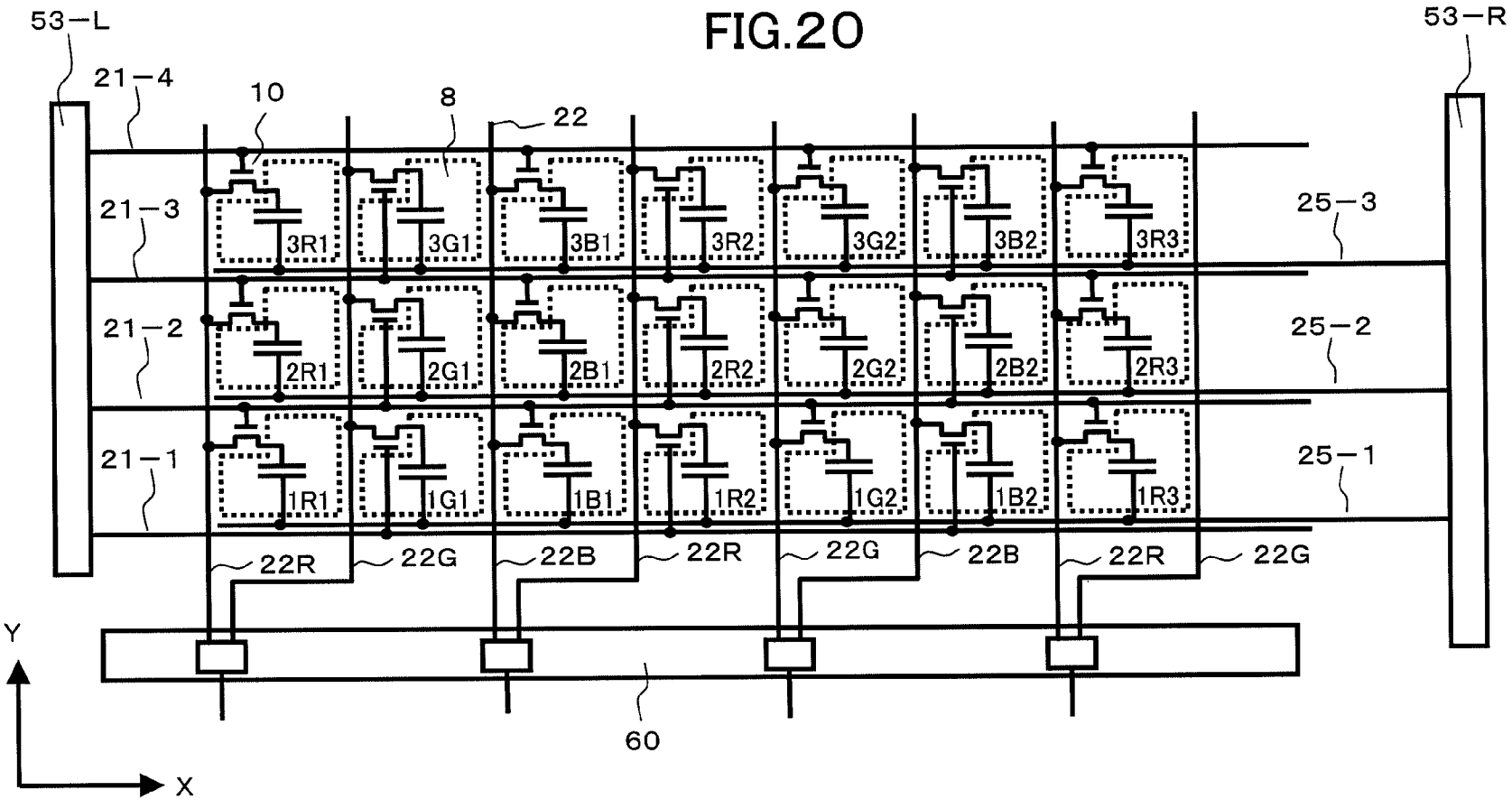
FIG. 20 is a circuit diagram schematically showing the liquid crystal display device according to the embodiment of the invention.

FIG. 20 illustrates a circuit containing the gate electrodes connected with the scanning lines 21 in a zigzag shape. As illustrated in FIG. 20, the scanning signal lines 21 extend in the X direction in the figure. The gate electrodes connected with the scanning signal lines 21 are alternately disposed in the Y direction in the figure for each pixel.

Thus, pixels having the thin film transistors 10 under ON condition and receiving image signals from the same scanning signal line 21 are shifted from one another in the Y direction. In this case, the two adjoining pixels in the X direction are driven by different scanning signal lines 21.

When a scanning signal is outputted to the scanning signal line 21-1, for example, an image signal is written to the pixels 1G1, 1R2, and 1B2. Thus, the image signal is written to half of the pixels connected with the counter electrode signal line 25-1.

When the scanning signal is subsequently outputted to the scanning signal line 25-2, the image signal is written to the remaining pixels 1R1, 1B1, 1G2, and 1R3 connected with the counter electrode signal line 25-1.

Simultaneously, the image signal is written to the pixels 2G1, 2R2, and 2B2 connected with the counter electrode signal line 25-2. Thus, the image signal can be written to the pixels connected with two counter electrode signal lines by using one scanning signal line when the gate electrodes are connected with the scanning signal lines 21 in a zigzag shape.

According to the circuit shown in FIG. 20, the image signal is written to half of the pixels connected with one counter electrode signal line 25 during one scanning period, and to the remaining pixels during another one scanning period. As a result, the pixels operated by one counter electrode signal line 25 can be reduced to half. Accordingly, the volume of charges to be supplied by one counter electrode signal line 25 is decreased to approximately half, and thus reduction of the burden of the counter electrode signal line 25 can be achieved.

Figure 21:
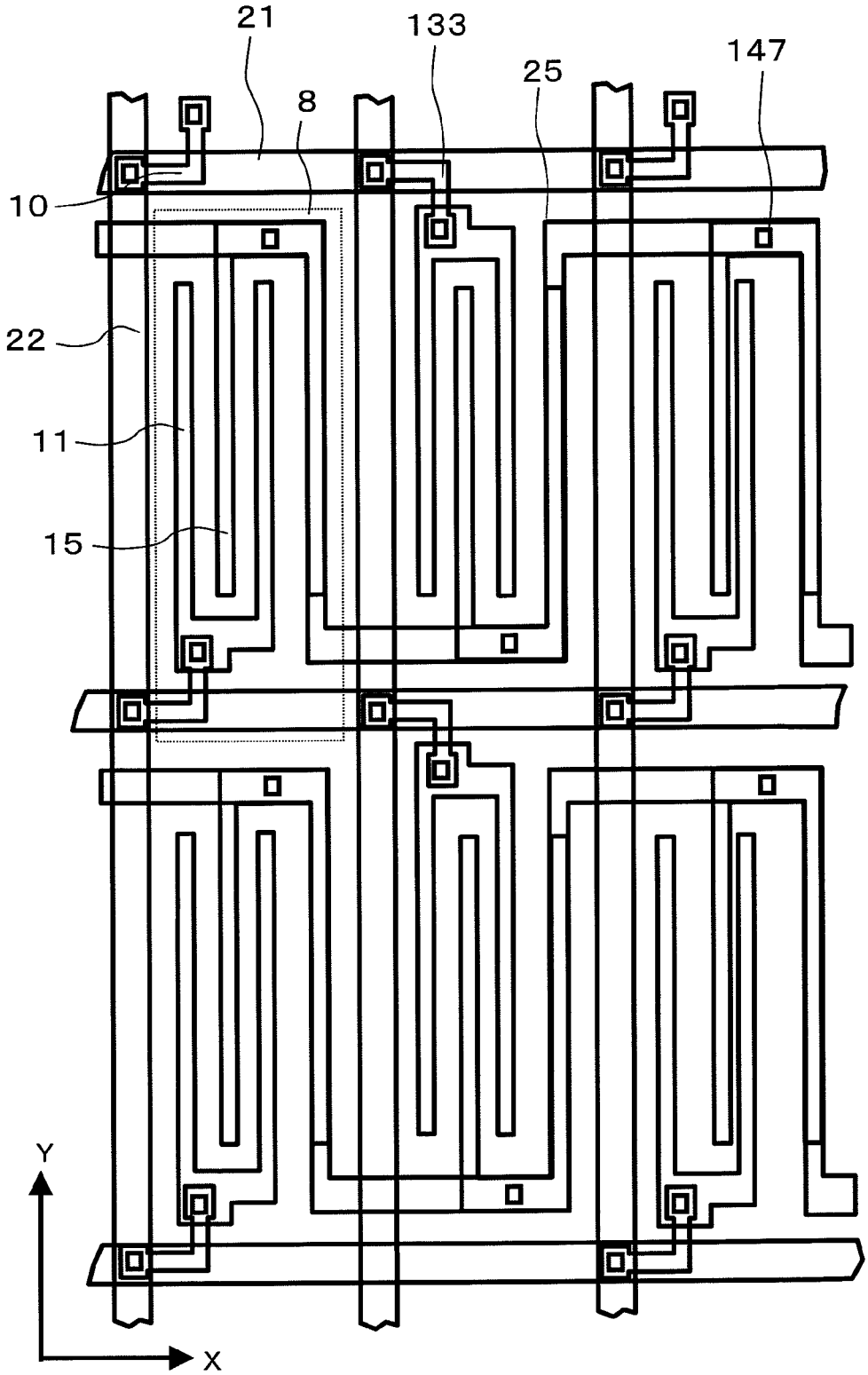
FIG. 21 is a plan view schematically showing the liquid crystal display device according to the embodiment of the invention.

FIG. 21 illustrates a general image structure of the circuit shown in FIG. 20. According to the structure shown in FIG. 21, the counter electrode signal line 25 is bended in a zigzag line in the Y direction. This structure eliminates overlaps between the source electrode 133 and the counter electrode signal line 25, and thus reduces generation of unnecessary incidental capacity.

According to the structure shown in FIG. 21, the counter electrode signal line 25 is disposed on the same layer as that of the scanning signal line 21, and the counter electrode 15 is disposed on the same layer as that of the pixel electrode 11. Thus, the counter electrode signal line 25 is connected with the counter electrode 15 via the through hole 147.

Figure 22:
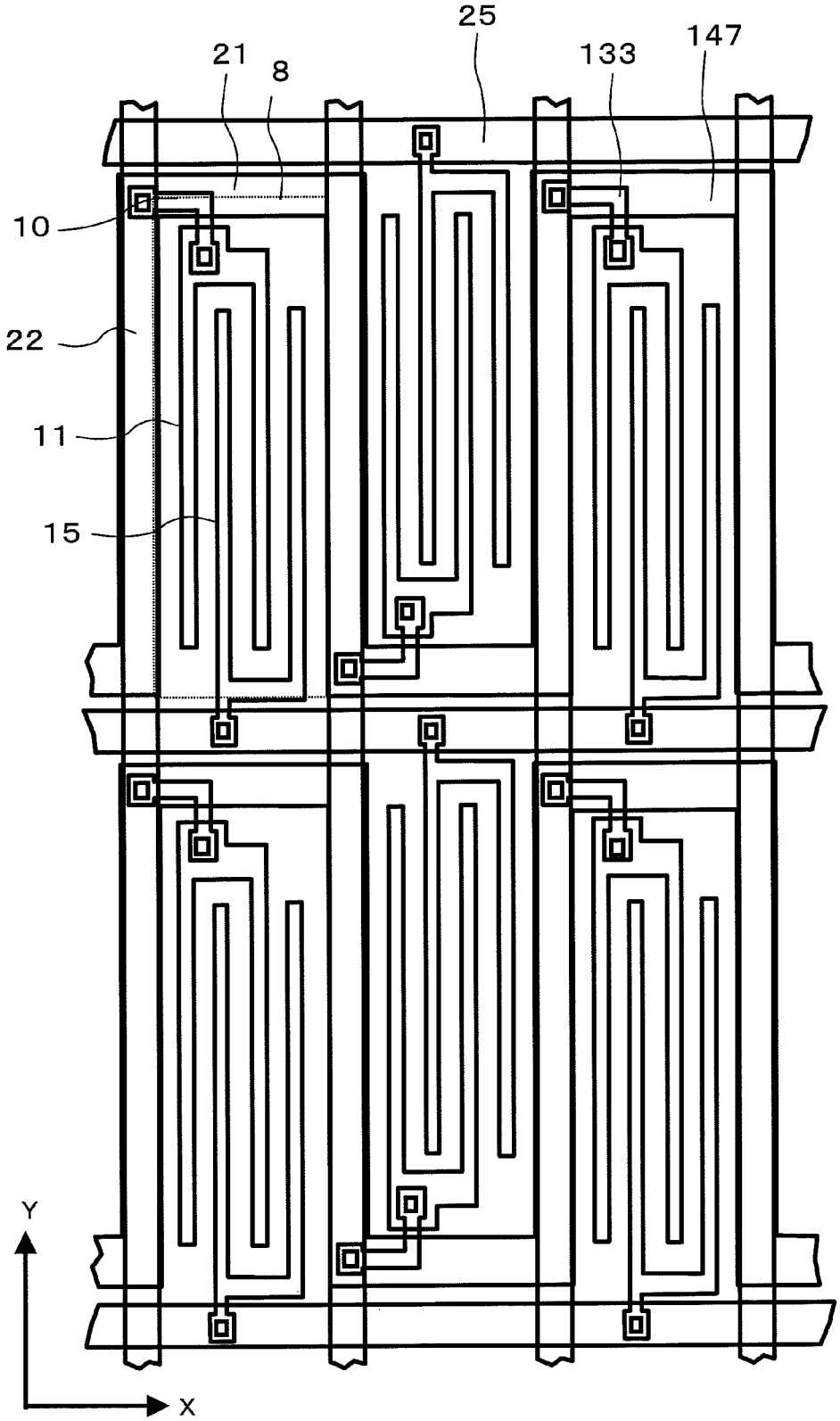
FIG. 22 is a plan view schematically showing the liquid crystal display device according to the embodiment of the invention.

FIG. 22 illustrates a general pixel structure containing the scanning signal line 21 extending in a zigzag line. The scanning signal line 21 overlapping with the image signal line 22 is bended in the Y direction. The zigzag-shape of the scanning signal line 21 allows connection of the adjoining pixels in the X direction with different counter electrode signal lines 25. Thus, image signals having different polarity can be written to the adjoining pixels in the X direction. In this case, the number of pixels operated by one counter electrode signal line 25 is reduced to half, and thus the volume of charges to be supplied by one counter electrode signal line 25 is reduced to approximately half. As a result, the burden on the counter electrode signal line 25 can be reduced.

Figure 23:
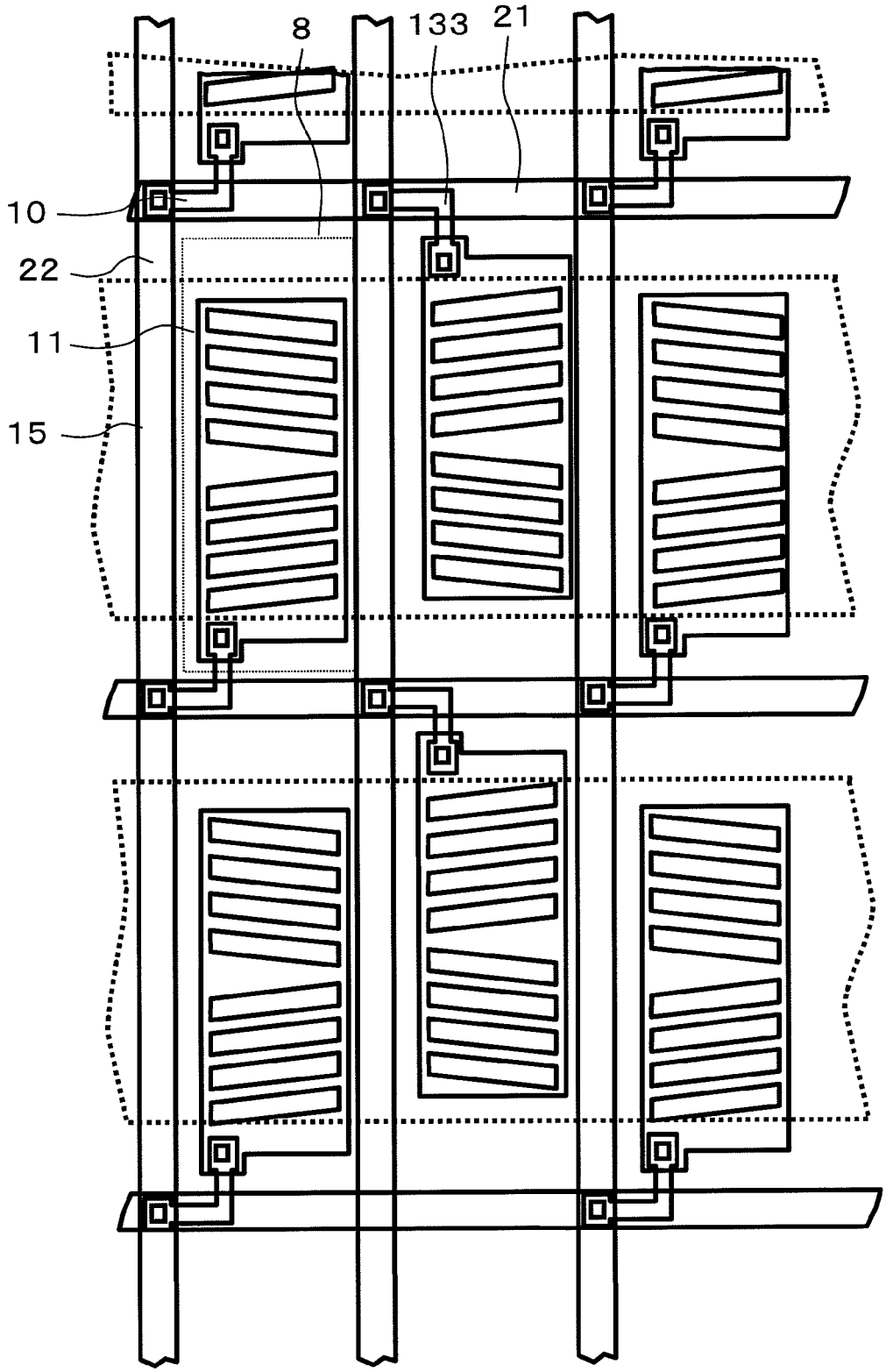
FIG. 23 is a plan view schematically showing the liquid crystal display device according to the embodiment of the invention.

FIG. 23 illustrates a general pixel structure containing the counter electrode 15 formed in a band shape under the layer of the pixel electrode 11. Since the counter electrode 15 is disposed under the layer of the pixel electrode 11, the necessity for overriding the counter electrode 15 is eliminated. Thus, the structure of the liquid crystal display panel 1 can be simplified.

What is claimed is:

1. A liquid crystal display device, comprising:
- a first substrate;
- a second substrate;
- a liquid crystal constituent sandwiched between the first substrate and the second substrate;
- a plurality of pixels provided on the first substrate;
- pixel electrodes provided on the pixels;
- counter electrodes opposed to the pixel electrodes;
- switching elements which supply image signals to the pixel electrodes when the switching elements are turned on;
- image signal lines which supply image signals to the switching elements;
- scanning signal lines which supply scanning signals for controlling ON and OFF of the switching elements;
- counter electrode signal lines which supply counter voltage to the counter electrodes;
- a first driver circuit which outputs the image signals;
- a second driver circuit which outputs the scanning signals; and
- a third driver circuit which outputs the counter voltage;
- a first pixel including a first pixel electrode and a first counter electrode which is opposed to the first pixel electrode; and
- a second pixel including a second pixel electrode and a second counter electrode which is opposed to the second pixel electrode;
- a first counter voltage which is supplied to the first counter electrode; and
- a second counter voltage which is supplied to the second counter electrode and is different from said first counter voltage;

wherein

- the first pixel is controlled by a first scanning signal line for receiving image signals;
- the second pixel is controlled by a second scanning signal line for receiving image signals;
- the third driver circuit outputs the second counter voltage which is generated from the first scanning signal; and
- the second counter voltage is inverted during a first scanning period for outputting scanning signals to the first scanning signal line.

* * * * *